US012539893B2

(12) United States Patent
Schuller et al.

(10) Patent No.: US 12,539,893 B2
(45) Date of Patent: Feb. 3, 2026

(54) GONDOLA RAILROAD CAR

(71) Applicant: Gunderson LLC, Portland, OR (US)

(72) Inventors: Daniel J. Schuller, North Richland Hills, TX (US); Peter L. Jones, Southlake, TX (US); Xiaoyan Lu, Arlington, TX (US)

(73) Assignee: Gunderson LLC, Lake Oswego, OR (US)

( * ) Notice: Subject to any disclaimer, the term of this patent is extended or adjusted under 35 U.S.C. 154(b) by 710 days.

(21) Appl. No.: 17/810,410

(22) Filed: Jul. 1, 2022

(65) Prior Publication Data

US 2024/0001969 A1 Jan. 4, 2024

(51) Int. Cl.

| | |
|---|---|
| ***B61D 17/04*** | (2006.01) |
| ***B61D 3/00*** | (2006.01) |
| ***B61D 17/06*** | (2006.01) |
| ***B61D 17/08*** | (2006.01) |
| ***B61D 17/10*** | (2006.01) |

(52) U.S. Cl.

CPC ..... *B61D 17/043* (2013.01); *B61D 3/00* (2013.01); *B61D 17/06* (2013.01); *B61D 17/08* (2013.01); *B61D 17/10* (2013.01)

(58) Field of Classification Search

CPC . B61D 3/00; B61D 9/00; B61D 17/00; B61D 17/04; B61D 17/043; B61D 17/06; B61D 17/08; B61D 17/10

See application file for complete search history.

(56) References Cited

U.S. PATENT DOCUMENTS

| | | | | |
|---|---|---|---|---|
| 664,646 A | | 12/1900 | King | |
| 922,787 A | * | 5/1909 | Lowry | B61F 1/00 105/415 |
| 1,627,216 A | | 5/1927 | Axel et al. | |
| 1,885,145 A | | 11/1932 | Shafer | |
| 1,914,053 A | | 6/1933 | Tatum | |
| 2,291,536 A | * | 7/1942 | Ditchfield | B61D 17/043 105/409 |

(Continued)

FOREIGN PATENT DOCUMENTS

| | | |
|---|---|---|
| CA | 2714733 A1 | 3/2011 |
| CA | 3078020 A1 | 11/2020 |

(Continued)

OTHER PUBLICATIONS

Marsh, Joanna, "Greenbrier, U.S. Steel and Norfolk Southern Green the Gondola", Freightwaves, available at https://www.freightwaves.com/news/greenbrier-us-steel-and-norfolk-southern-green-the-gondola, Dec. 9, 2021.

(Continued)

*Primary Examiner* — Cheng Lin

(74) *Attorney, Agent, or Firm* — Neal, Gerber & Eisenberg LLP

(57) ABSTRACT

A gondola railroad car partially formed using members of high strength steel, that is lighter than conventional gondola railroad cars, that can carry more weight than conventional gondola railroad cars, that is less prone to damage than conventional gondola railroad cars, and that has a longer lifespan than convention gondola railroad cars. In various such embodiments, the floor and the side walls of the gondola railroad car are partially formed from ultra-high strength steel members.

31 Claims, 31 Drawing Sheets

(56) References Cited

U.S. PATENT DOCUMENTS

| | | | | |
|---|---|---|---|---|
| 2,344,222 | A | 3/1944 | George | |
| 2,736,270 | A | 2/1956 | Esher | |
| 3,121,260 | A | 2/1964 | Decker et al. | |
| 3,386,600 | A | 6/1968 | Betjemann | |
| 4,930,427 | A * | 6/1990 | Ritter | B61D 17/08 105/407 |
| 5,386,674 | A | 2/1995 | Sfirakis et al. | |
| 5,501,556 | A * | 3/1996 | Butcher | B60P 1/6481 410/121 |
| 6,601,522 | B2 | 8/2003 | Roxby | |
| 7,478,599 | B1 | 1/2009 | Lydic et al. | |
| 7,543,367 | B2 * | 6/2009 | Beers | B61D 17/18 29/469 |
| 7,784,411 | B2 * | 8/2010 | Forbes | B61D 17/08 296/183.1 |
| 8,215,240 | B2 | 7/2012 | Graaff et al. | |
| 9,156,478 | B2 * | 10/2015 | Forbes | B61D 17/08 |
| 10,737,705 | B2 | 8/2020 | Kress et al. | |
| 12,195,056 | B2 * | 1/2025 | Du | B61D 17/08 |
| 2007/0101895 | A1 * | 5/2007 | Forbes | B61D 17/00 105/406.1 |
| 2020/0346670 | A1 * | 11/2020 | Nelle | B61F 1/06 |

FOREIGN PATENT DOCUMENTS

| | | | |
|---|---|---|---|
| CN | 202243480 | U | 5/2012 |
| CN | 108313084 | B | 7/2019 |
| EP | 3862243 | A1 | 8/2021 |
| GB | 526138 | A | 9/1940 |
| GB | 2092535 | A | 8/1982 |
| RU | 61662 | U1 | 3/2007 |
| WO | 2015097366 | A1 | 7/2015 |

OTHER PUBLICATIONS

"Pictures of Truck Bodies Formed Using High Strength Steel", available prior to the filing date of this application.

* cited by examiner

GONDOLA RAILROAD CAR

BACKGROUND

The railroad industry employs a variety of different railroad cars for transporting different materials. For example, various known railroad cars that are configured to carry loose materials are often called "gondola railroad cars." Various known gondola railroad cars are relatively heavy and are therefore somewhat limited in the weight of the cargo that they can carry due to the overall combined weight limitations for railroad cars (including the cargo they carry). Various known gondola railroad cars are also subject to various different types of damage to their cargo compartments—which can lead to extra maintenance costs and can limit the lifespans of such gondola railroad cars. Accordingly, there is a continuing need to provide gondola railroad cars that are lighter (and thus have the ability to carry heavier cargo), are less prone to damage, require less maintenance, and have longer expected lifespans.

Gondola railroad cars using high strength steels have not been commercially developed due in part to various different limitations in using such high strength steels. One of these limitations relates to the fatigue that would be present at or along the welds that would connect separate pieces of such high strength steel to form the gondola railroad car. Another one of these limitations relates to the concern for how railroad cars built with high strength steels will be repaired in the field, and how to ensure that such railroad cars can be and are repaired correctly.

SUMMARY

Various embodiments of the present disclosure provide a gondola railroad car partially formed using multiple members of high strength steel, that is lighter than conventional gondola cars, that can carry more weight than conventional gondola railroad cars, that is less prone to damage than convention gondola cars, that requires less maintenance than conventional railroad gondola cars, and that has a longer expected lifespan than conventional gondola railroad cars. Various embodiments of the present disclosure enable the floor and sides walls of a gondola railroad car to be made from multiple members of high strength steel and particularly ultra-high strength steel in part by locating the welds that connect such separate pieces of ultra-high strength steel at designated weld connection areas and in part by supporting such members in certain manners described herein.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
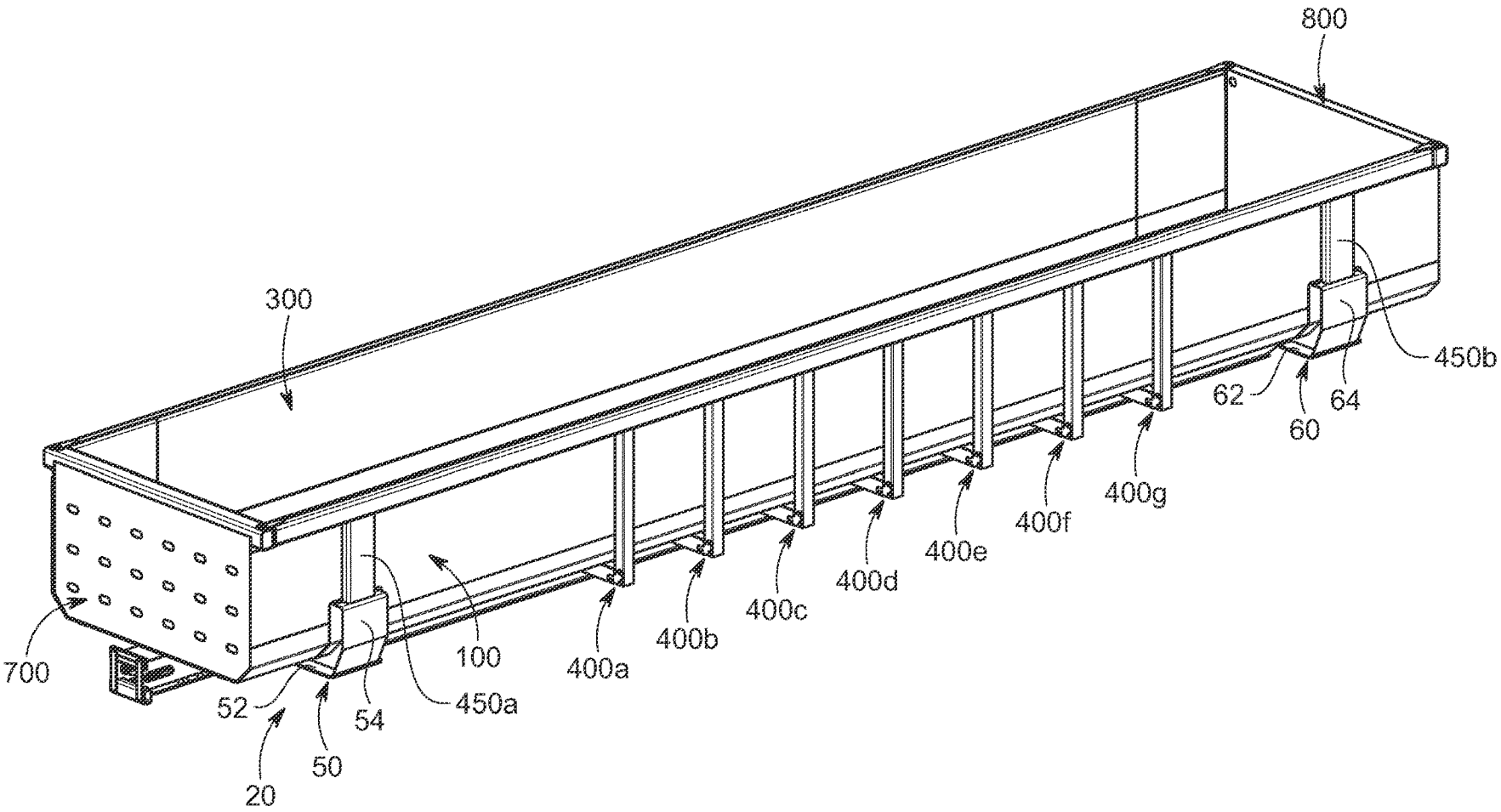
FIG. 1 is a top perspective view of a gondola railroad car of one example embodiment of the present disclosure, shown without the trucks and wheels of the gondola railroad car and including elongated longitudinally extending high strength steel members.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Various embodiments of the present disclosure provide a gondola railroad car having a containment structure including a floor, a first side wall, a second side wall, a first floor-side-wall connector, a second floor-side-wall connector, a first end wall, and a second end wall each formed from high strength steel and particularly from ultra-high strength steel.

In various embodiments, the floor, the first side wall, the second side wall, the first floor-side-wall connector, and the second floor-side-wall connector area are each formed from a single member of high strength steel and particularly from ultra-high strength steel, and then suitably connected. This configuration reduces the quantity of welds and the fatigue in such components caused by such welds. In various such embodiments, only longitudinal welds are employed because they run parallel to the direction of the forces acting on the structure and therefore have more resistance to fatigue than transverse welds that run perpendicular to the forces acting on the structure.

In various embodiments, the first floor-side wall connector is formed from or defined by a part of the first side wall and/or a part of the floor, and the second floor-side-wall connector is formed from or defined by a part of the second side wall and/or a part of the floor.

In various embodiments, one of, a plurality of, or each of the floor, the first side wall, the second side wall, the first floor-side-wall connector, and the second floor-side-wall connector are formed from or multiple members of high strength steel and particularly from ultra-high strength steel that are suitably attached by welding at designated weld connection areas.

In various embodiments, each of the floor, the first side wall, the second side wall, the first floor-side-wall connector, and the second floor-side-wall connector are formed from a series of transversely extending members of high strength steel and particularly from ultra-high strength steel that are suitably attached by welding at designated weld connection areas. In various such embodiments, each transversely extending member forms a portion of each of the floor, the first side wall, the second side wall, the first floor-side-wall connector, and the second floor-side-wall connector. In various such embodiments that employ one or more transverse welds, each weld connection area for such transverse welds is specifically supported and isolated to increase resistance to fatigue caused by such transverse welds.

In various embodiments, the respective opposite end members of each of the floor, the first side wall, the second side wall, the first floor-side-wall connector, and the second floor-side-wall connector have an increased thickness of high strength steel and particularly from ultra-high strength steel.

In various embodiments, the floor, the first side wall, the second side wall, the first floor-side-wall connector, and the second floor-side-wall connector are each supported at one or more locations by different supporting components to minimize any fatigue or weaknesses at designated weld connection areas.

In various embodiments, the floor, the first side wall, and the second side wall, are each directly supported at multiple locations by different supporting components to the first floor-side-wall connector and the second floor-side-wall connector are indirectly supported.

It should be appreciated that the ability of a steel to resist permanent deformation is often expressed in units of "ksi" (or kilo-pounds per square inch with one ksi being equal to 1,000 pounds per square inch). It should further be appreciated that the higher the ksi the more resistant the steel is to permanent deformation. The unit "ksi" can be considered as a measure of the tensile strength of steel. Tensile strength measures the level of stress a material can take before failing. This often refers to the stress created by stretching or pulling the material apart.

In various embodiments, each steel member of the floor and side walls of the gondola railroad car has a yield strength in the range from 100 ksi through 175 ksi. In various embodiments, certain steel members of the end walls of the gondola railroad car have a yield strength in the range from 100 ksi through 175 ksi. In various embodiments, each steel member of the floor and side walls of the gondola railroad car has a yield strength of 175 ksi. In various embodiments, certain steel members of the end walls of the gondola railroad car has a yield strength of 175 ksi.

In various embodiments of the present disclosure, the respective length and/or widths of one or more of the high strength steel and particularly the ultra-high strength steel members that are used to form the floor, the first side wall, the second side wall, the first floor-side-wall connector, and the second floor-side-wall connector are based on the lengths and widths of the high strength steel and particularly the ultra-high strength steel that is provided by manufacturers of such steel. The availability of lengths, widths, and thicknesses can vary depending on a manufacturer's equipment and the volumes for the different steel sheet and plate sizes. In various embodiments, one or more of the high strength steels and particularly the ultra-high strength steel member or certain combinations thereof can be a single monolithically formed member similar to current lower strength steels.

For purposes of description of the components of each example gondola railroad car described herein, the longitudinal direction is generally used to describe a direction of travel of or the length of the gondola railroad car, and the transverse direction is generally used to describe a direction lateral or perpendicular to the direction of travel of the gondola railroad car.

Referring now to the drawings, FIGS. 1, 2, 3, 4, 5, 6, 7A, 7B, and 8 illustrate certain components of a gondola railroad car 20 of a first example embodiment of the present disclosure. This gondola railroad car 20 includes: (1) a frame 30; (2) spaced apart trucks (not shown) configured to support the frame 30; and (3) a plurality of sets of wheels (not shown) that respectively support the trucks. The gondola railroad car 20 includes a containment structure including: (4) a floor 100 connected to and supported by the frame 30; (5) a first side wall 200 connected to and extending upwardly from the floor 100; (6) a spaced-apart second side wall 300 connected to and extending upwardly from the floor 100; (7) a first end wall 700 connected to the floor 100, the first side wall 200, and the second side wall 300; and (8) a spaced-apart second end wall 800 connected to the floor 100, the first side wall 200, and the second side wall 300. In this example embodiment, the first side wall 200 defines the first floor-side-wall connector and the second side wall 300 defines the second floor-side-wall connector, as further described below. This gondola railroad car 20 includes a containment support assembly including: (9) a plurality of spaced-apart first side wall support brackets 400*a*, 400*b*, 400*c*, 400*d*, 400*e*, 400*f*, and 400*g* connected to and extending upwardly from the frame 30 and connected to the floor 100 and the first side wall 200; (10) a pair spaced-apart first side wall end support brackets 450*a* and 450*b* connected to and extending upwardly from the frame 30 and connected to the first side wall 200; (11) a plurality of spaced-apart second side wall support brackets 500*a*, 500*b*, 500*c*, 500*d*, 500*e*, 500*f*, and 500*g* connected to and extending upwardly from the frame 30 and connected to the floor 100 and the second side wall 300; and (12) a pair spaced-apart second side wall end support brackets 550*a* and 550*b* connected to and extending upwardly from the frame 30 and connected to the second side wall 200.

Figure 2:
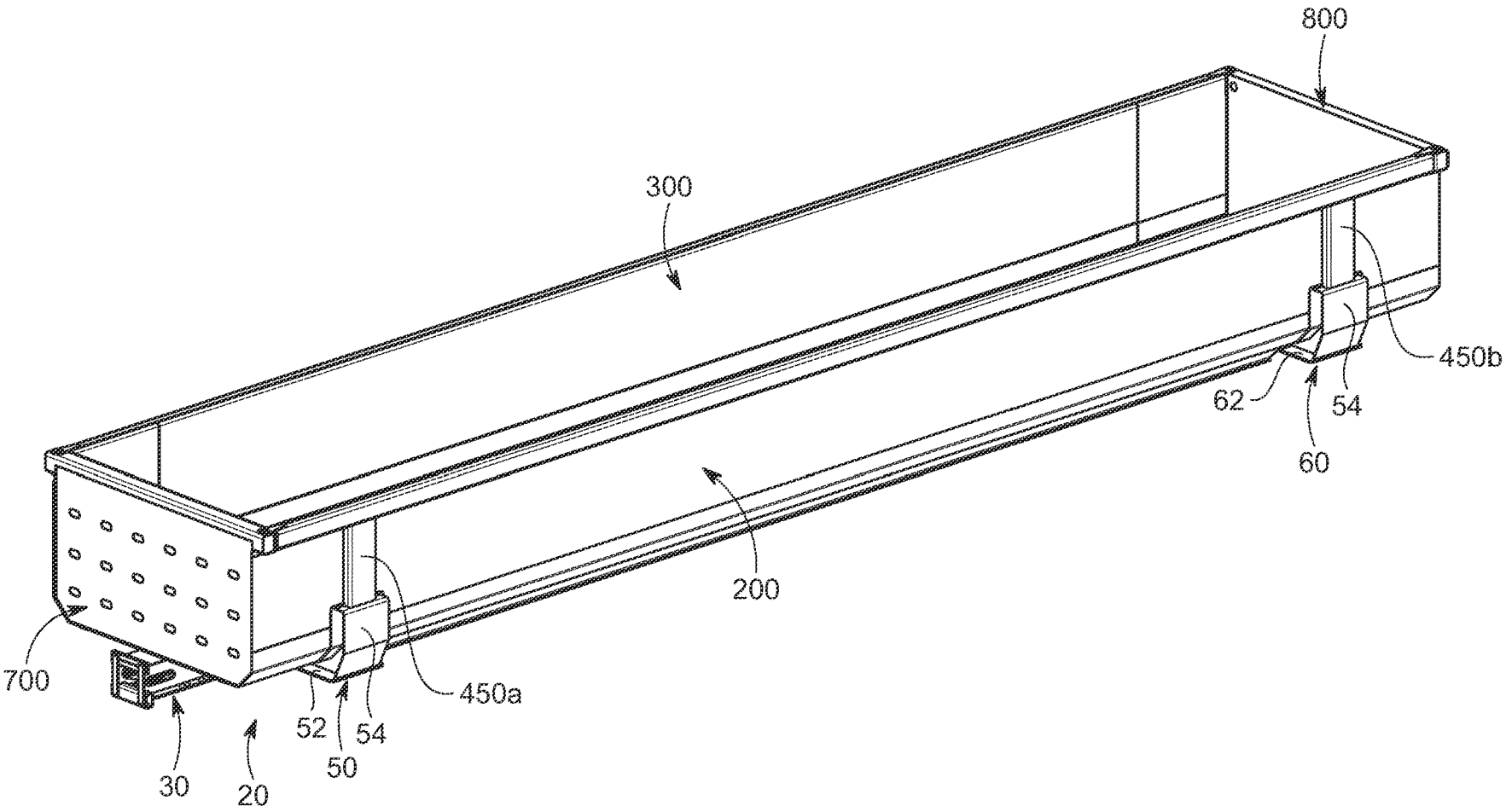
FIG. 2 is a top perspective view of the gondola railroad car of FIG. 1, shown without the first side wall support brackets that have been removed for clarity, and shown without the trucks and wheels of the gondola railroad car.
Figure 3:
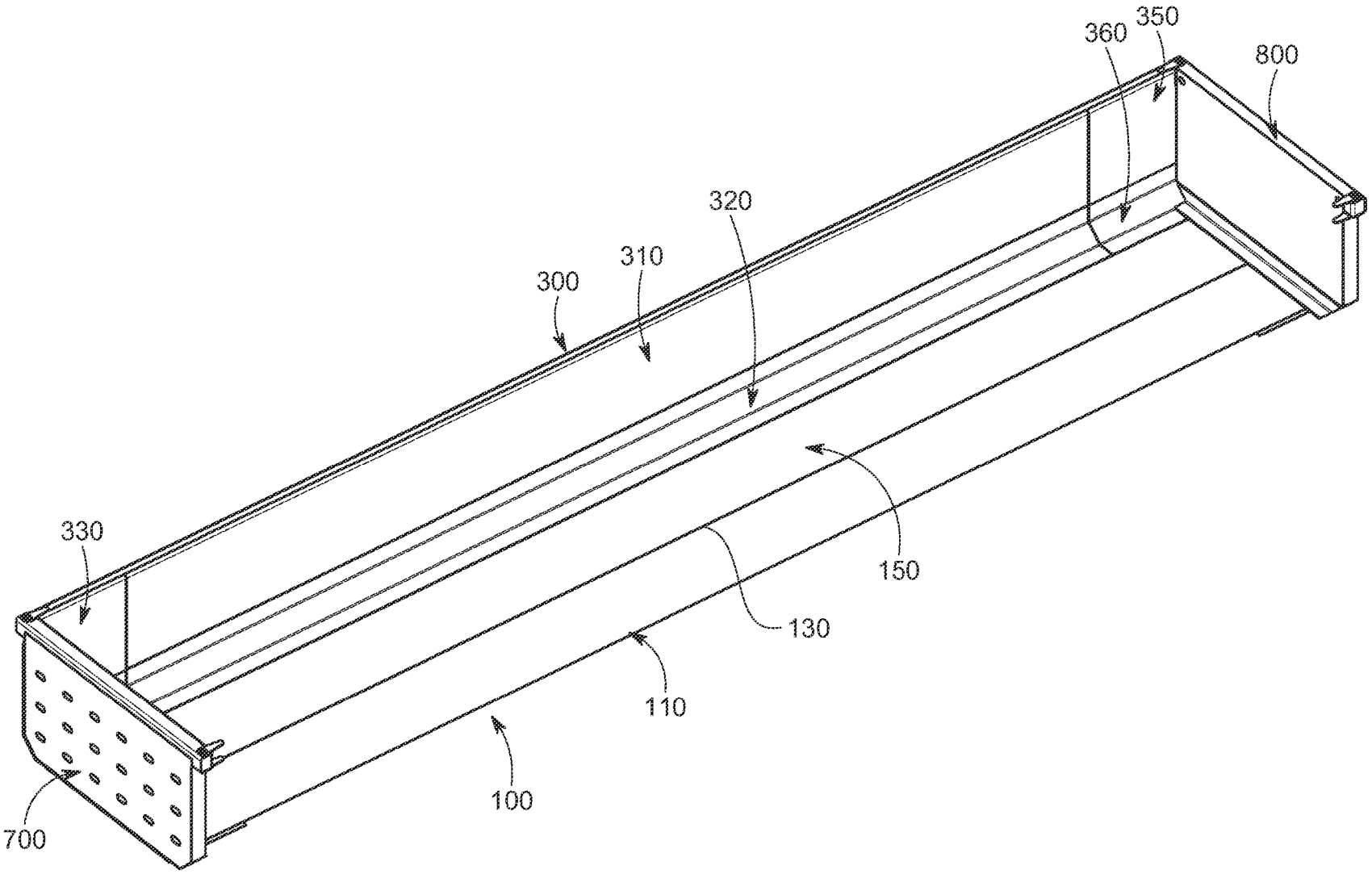
FIG. 3 is a fragmentary view of the gondola railroad car of FIG. 1, shown with the first side wall and the first side wall support brackets removed to show the construction of the floor of the gondola railroad car, and shown without the trucks and wheels of the gondola railroad car.
Figure 4:
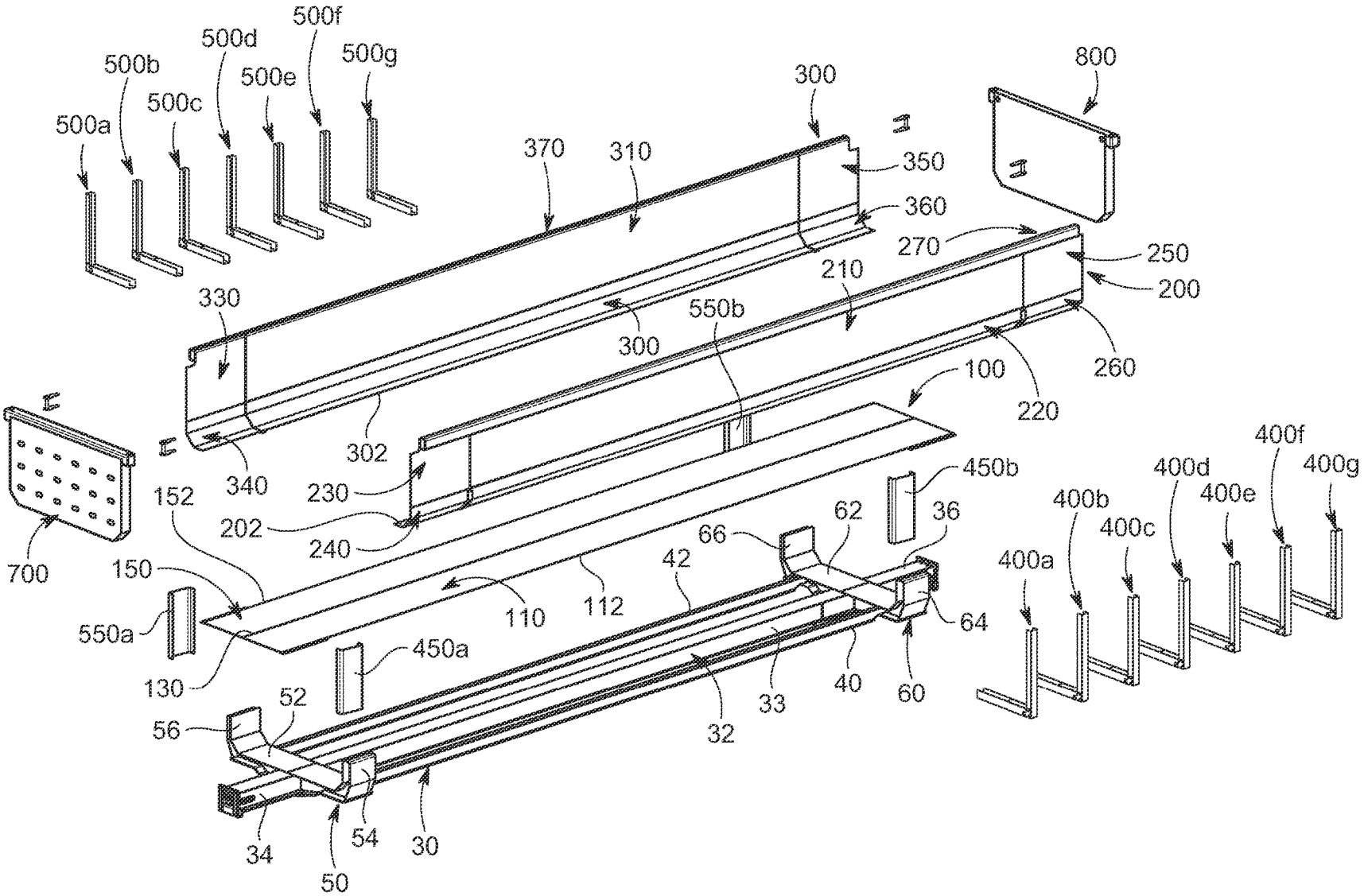
FIG. 4 is a top perspective exploded view of the gondola railroad car of FIG. 1 with certain components removed, and shown without the trucks and wheels of the gondola railroad car.

More specifically, the frame 30 includes an elongated longitudinally extending center sill 32 that includes a longitudinally extending central member 33, a longitudinally extending first stub sill assembly 34 at a first end of the center sill 32, and a longitudinally extending second stub sill assembly 36 at the opposite second end of the center sill 32, as best shown in FIG. 4. As shown in FIGS. 1, 2, and 4, the frame 30 also includes a first U-shaped body support 50 connected to and extending transversely from the center sill 32 and a second U-shaped body support 60 connected to and extending transversely from the center sill 32. The first U-shaped body support 50 includes a transversely extending base 52 and spaced-apart upwardly extending bracket receivers 54 and 56 connected to opposite transverse ends of the base 52. Likewise, the second U-shaped body support 60 includes a transversely extending base 62 and spaced-apart upwardly extending bracket receivers 64 and 66 connected to opposite transverse ends of the base 62. The frame 30 further includes an elongated longitudinally extending first side floor support 40 spaced from the center sill 32 and an elongated longitudinally extending second side floor support 42 spaced from the center sill 32. The first side floor support 40 is connected to and extends between the base 52 of the first U-shaped body support 50 and the base 62 of the second U-shaped body support 60 on a first side of the center sill 32. The second side floor support 42 is connected to and extends between the base 52 of the first U-shaped body support 50 and the base 62 of the second U-shaped body support 60 on a second side of the center sill 32.

In this example embodiment, the frame 30 is made from steel members, wherein each steel member has a yield strength in the range from 50 ksi through 100 ksi. It should be appreciated that the frame can be alternatively shaped, sized, and otherwise configured in accordance with the present disclosure such as but not limited to the alternative configuration explained below.

The floor 100 includes an elongated longitudinally extending steel member that extends substantially the length of the car 20 from the first end wall 700 to the second end wall 800. The floor 100 is flat and extends horizontally or substantially horizontally. In this embodiment, the floor 100 is formed from two elongated longitudinally extending ultra-high strength steel members 110 and 150 that are welded together along a central weld connection area 130. The central weld connection area 130 is directly supported by the center sill 32 of the frame 30 such that the central weld connection area 130 does not create a weakened area for the gondola railroad car 20. In certain such embodiments, the combined width of each of the connected members 110 and 150 employed to form the floor 100 can be equal to the width of the steel coil used to form such member. Example coil widths can vary from 40 inches to 80 inches depending on the supplier, steel grade, thickness, and length. The floor 100 can be directly connected to the frame 30 by a plurality of welds (not shown) between the bottom surface of the floor 100 and (i) the central member 33 of the center sill 32, (ii) the base 52 of the first U-shaped body support 50, (iii) the base 62 of the second U-shaped body support 60, (iv) the first side floor support 40, and (v) the second side floor support 42. In this example embodiment, the floor 100 is formed from two equally sized and shaped multiple members of high strength steel and particularly from ultra-high strength steel having a yield strength of 175 ksi.

In this example embodiment, the first side wall 200 includes an elongated longitudinally extending partially flat and partially bent steel member that extends substantially the length of the car 20 from the first end wall 700 to the second end wall 800. In this embodiment, the first side wall 200 is formed from six ultra-high strength steel members including: (1) an elongated flat central upper member 210; (2) an elongated bent central lower member 220; (3) a first end flat upper member 230; (4) a first end bent lower member 240; (5) a second end flat upper member 250; and (6) a second end bent lower member 260. In this example embodiment, the first floor-side-wall connector includes the elongated bent central lower member 220, the first end bent lower member 240, and the second end bent lower member 260. These six members are welded together at respective weld connection areas (not labeled) connecting: (a) member 210 to members 220, 230 and 250, (b) member 220 to members 240 and 260, (c) member 230 to member 240, and (d) member 250 to 260. The upper members 210, 230, and 250 are each substantially flat and extend vertically or substantially vertically. The bent lower members 220, 240, and 260 each include two longitudinally extending inward bends (each at approximately 45 degrees) such that: (a) the lower portion of each of these members extends at a right angle or substantially at a right angle to the upper portion of the respective member; (b) a lower most edge 202 of the first side wall 200 engages and mates with a first side edge 112 of the floor 100; and (c) a weld (not shown) connects such edges 202 and 112 along a weld connection area (not labeled). In this example embodiment, the first side wall 200 is formed from multiple members of high strength steel and particularly ultra-high strength steel having a 175 ksi. Other example embodiments such as those explained below can vary depending on the length, width and thickness of material available from steel manufacturers, and the manufacturing equipment available to the manufacturer to bend the material and weld the pieces together.

In this example embodiment, the weld connection areas connecting members 230 and 240 to members 210 and 220 and the weld connection areas connecting members 250 and 260 to members 210 and 220 are respectively positioned over or substantially aligned with the spaced-apart trucks (not shown) that support the gondola railroad car 20 and thus are spaced from the higher stress central areas of the gondola railroad car 20.

The first side wall 200 further includes an upper brace 270 connected to the upper members 210, 230, and 250. The upper brace 270 includes an elongated longitudinally extending tubular member and is welded to the outer surface of the upper end of the upper members 210, 230, and 250 of the first side wall 200 such that the upper brace 270 forms part of an upper rim of the railroad car 20. In this example embodiment, the upper brace 270 made from a steel member made from 100 ksi material. In other embodiments, the upper brace 270 has a yield strength in the range from 100 ksi through 175 ksi. It should be appreciated that the upper brace 270 can be alternatively shaped, sized, and otherwise configured in accordance with the present disclosure.

Likewise, in this example embodiment, the second side wall 300 includes an elongated longitudinally extending partially flat and partially bent steel member that extends substantially the length of the car 20 from the first end wall 700 to the second end wall 800. In this embodiment, the second side wall 3200 is formed from six ultra-high strength steel members: (1) an elongated flat central upper member 310; (2) an elongated bent central lower member 320; (3) a first end flat upper member 330; (4) a first end bent lower member 340; (5) a second end flat upper member 350; and (6) a second end bent lower member 360. In this example embodiment, the second floor-side-wall connector include the elongated bent central lower member 320, the first end bent lower member 340, and the second end bent lower member 360. These members are welded together at respective weld connection areas (not labeled) connecting: (a) member 310 to members 320, 330 and 350, (b) member 320 to members 340 and 360, (c) member 330 to member 340, and (d) member 350 to 360. The upper members 310, 330, and 350 are each substantially flat and extend vertically or substantially vertically. The lower members 320, 340, and 360 each include two longitudinally extending inward bends (each at approximately 45 degrees) such that: (a) the lower portion of each of these members extend at a right angle or substantially at a right angle to the upper portion of the respective member; (b) a lower most edge 302 of the second side wall 300 engages and mates with a second side edge 152 of the floor 100; and (c) a weld (not shown) connects such edges 302 and 152 at a weld connection area (not labeled). In this example embodiment, the second side wall 300 is formed from multiple members of ultra-high strength steel having a yield strength of 175 ksi. Other example embodiments such as described below will vary depending on the length, width and thickness of material available from suppliers, and the manufacturing equipment available to the manufacturer to bend the material and weld the pieces together.

In this example embodiment, the weld connection areas connecting members 330 and 340 to members 310 and 320 and the weld connection areas connecting members 350 and 360 to members 310 and 320 are respectively positioned over or substantially aligned with the spaced-apart trucks (not shown) that support the gondola railroad car 20 and thus are spaced from the high stress central areas of the gondola railroad car 20.

The second side wall 300 further includes a longitudinally extending upper brace 370 connected to the upper members 310, 330, and 350. The upper brace 370 includes an elongated tubular member and is welded to the outer surfaces of the upper end of the upper members 310, 330, and 350 of the second side wall 300 such that the upper brace forms part of the upper rim of the railroad car 20. In this example embodiment, the upper brace 370 made from a steel member made from 100 ksi material. In other embodiments, the upper brace 370 has a yield strength in the range from 100 ksi through 175 ksi. It should be appreciated that the upper brace 370 can be alternatively shaped, sized, and otherwise configured in accordance with the present disclosure.

In various embodiments, the first and/or second side walls can include one or more elongated weld connection area reinforcement members (not shown). Each of these reinforcement members can be intermittent or can extend the entire length of the side walls 200 and 300.

In various embodiments: (1) the first end flat upper member 230; (2) the first end bent lower member 240; (3) the second end flat upper member 250; (4) the second end bent lower member 260; (5) the first end flat upper member 330; (6) the first end bent lower member 340; (7) the second end flat upper member 350; and (8) the second end bent lower member 360, each have a greater thicknesses than the central members of the side walls. Likewise, in various embodiments, each of the respective opposite end members of the floor 100 can have greater thicknesses than the central members of the floor 100. These increased or greater thicknesses provide additional strength and support during longitudinal loading on the end walls 700 and 800.

Other embodiments can vary depending on the length, width and thickness of material available from manufacturers, the methods available to the manufacturers for welding the various members together, and the manufacturing equipment available to the manufacturers to bend the material and weld the pieces together.

The plurality of first side wall support brackets 400*a*, 400*b*, 400*c*, 400*d*, 400*e*, 400*f*, and 400*g* are spaced-apart along the longitudinal length of and adjacent to the outer surfaces of the floor 100 and the first side wall 200 to provide additional support for the floor 100 and the first side wall 200 at designated areas. The first side wall support brackets 400*a*, 400*b*, 400*c*, 400*d*, 400*e*, 400*f*, and 400*g* are not positioned along but rather positioned transversely to the weld connection areas of the floor 100 and the side wall 200 in this example embodiment. This arrangement limits the amount the unsupported members of the wall and floor can deflect under load. The first side wall support brackets 400*a*, 400*b*, 400*c*, 400*d*, 400*e*, 400*f*, and 400*g* are identical in this example embodiment, so only side wall support bracket 400*a* is described in detail herein for brevity.

Figure 5:
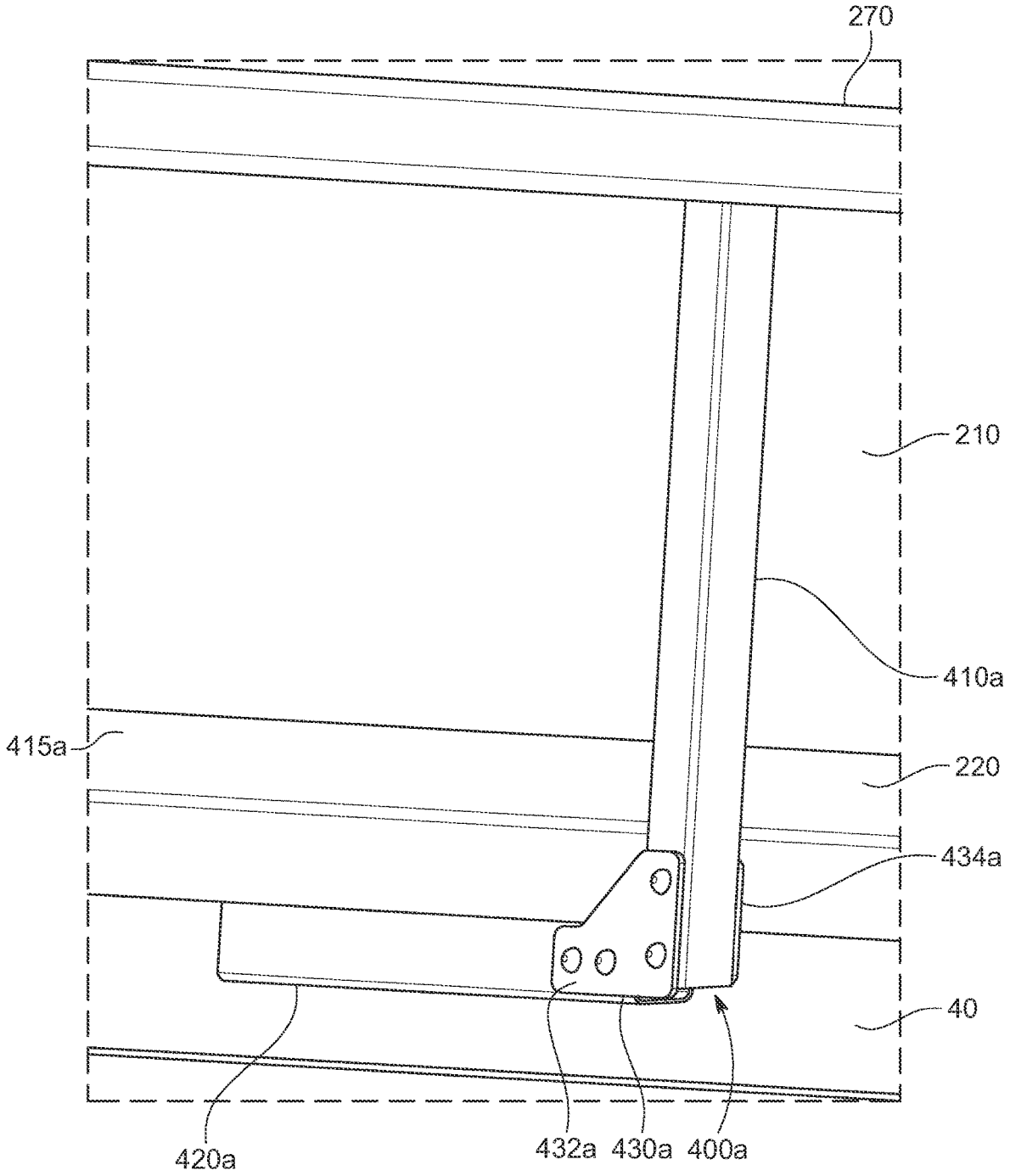
FIG. 5 is an enlarged fragmentary side perspective view of part of the gondola car of FIG. 1 showing part of the first side wall and one of the first side wall support brackets of the gondola railroad car.
Figure 6:
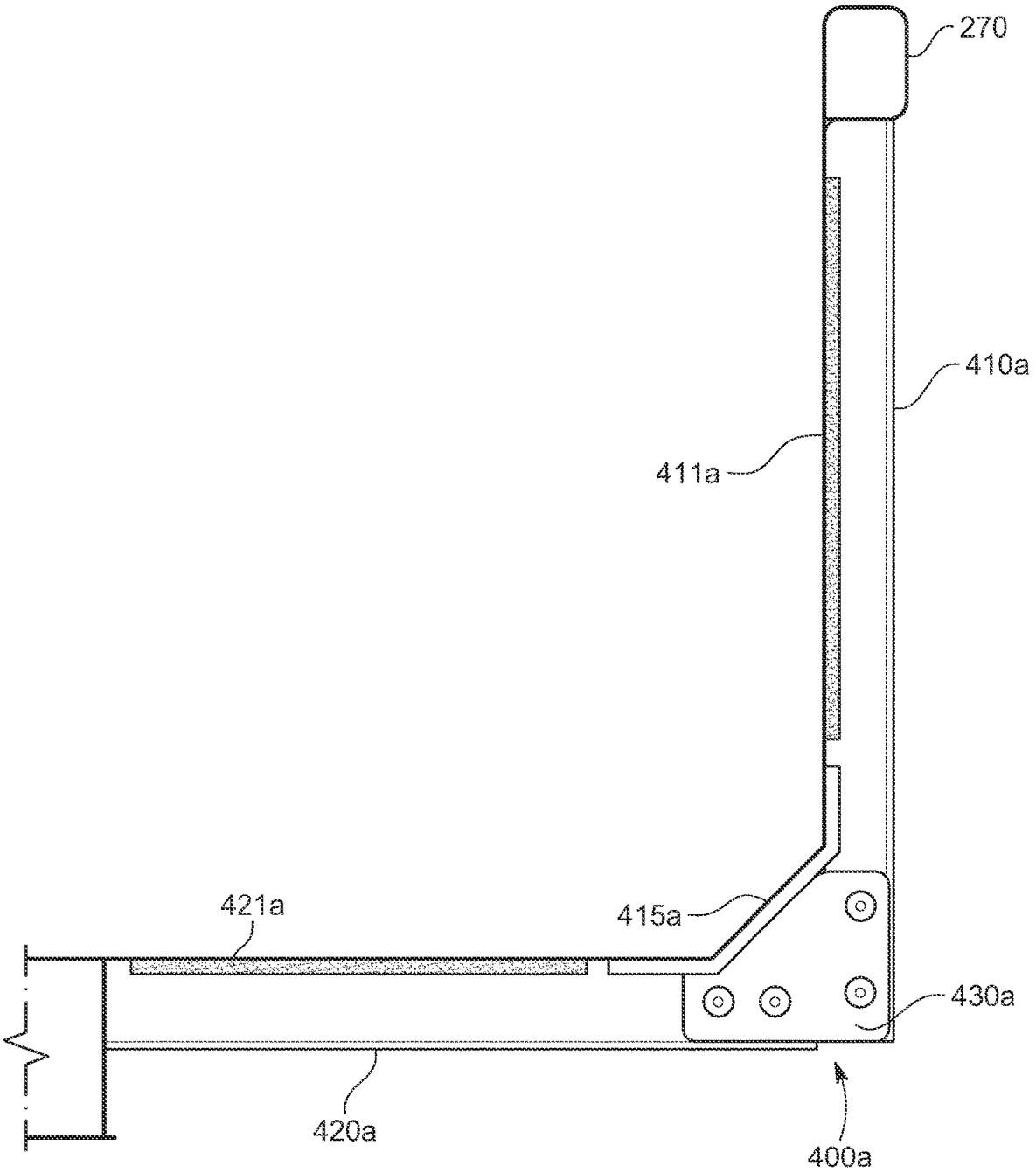
FIG. 6 is an enlarged side view of the first side wall support bracket of FIG. 5 of the gondola railroad car of FIG. 1.

As best shown in FIGS. 5 and 6, the side wall support bracket 400*a* includes an upwardly vertically extending side wall support 410*a*, an outwardly horizontally extending floor support 420*a*, and a corner support 430*a* connecting the lower portion of the side wall support 410*a* to the outer portion of floor support 420*a*.

More specifically, the side wall support 410*a* includes a U-shaped member including an outer wall (not labeled) and two inwardly extending inner walls (not labeled). The two inwardly extending inner walls are welded to the outer surface of the side wall 210 along a weld connection area 411*a*. The welding of the side wall support 410*a* to the outer surface of the side wall 200 along weld connection area 411*a* creates a rigid connection between the side wall 200 and the side wall support 410*a* at the weld connection area 411*a*. This weld connection area 411*a* and thus this rigid connection is above the first floor-side-wall connector indicated by numeral 415*a* as shown in FIG. 6. In other words, the first floor-side-wall connector is not rigidly connected to the side wall support 410*a* in this embodiment.

The floor support 420*a* includes a U-shaped member including an outer wall (not labeled) and two inner walls (not labeled) extending upwardly from the outer wall and welded to the bottom outer surface of the floor 100 along weld connection area 421*a*. The floor support 420*a* is also attached to the center support assembly 32. The attachment of floor support 420*a* to the center support assembly 32 turns the floor support 420*a* into a cantilevered load bearing member that supports the floor 100 and the side assembly 200 through the side wall support 410*a*. The welding of the floor support 420*a* to the bottom outer surface of the floor 100 along weld connection area 421*a* creates a rigid connection between the floor 100 and the floor support 420*a* at the weld connection area 421*a*. This weld connection area 421*a* and thus this rigid connection is inward of the first floor-side-wall connector 415*a* as shown in FIG. 6. In other words, the first floor-side-wall connector 415*a* is not rigidly connected to the floor support 420*a* in this embodiment.

The corner support 430*a* includes two spaced-apart plates 432*a* and 434*a* and four fasteners (not labeled) (such as bolts and nuts) connecting the plates 432*a* and 434*a*, the side wall support 410*a*, and the floor support 420*a*. This configuration of the corner support 430*a* creates a non-rigid connection between the side wall support 410*a* and the floor support 420*a*. This non-rigid connection (which does not include any welding) facilitates use of the full strength of the components without any welding induced fatigue to these components. Additionally, the corner support 430*a* is not welded to the first floor-side-wall connector 415*a* and thus create a non-rigid support for the first floor-side-wall connector 415*a*. These non-rigid connections enable the resulting joint to flex to a certain extent to absorb loads. It should thus be appreciated that the first side wall support brackets 400*a*, 400*b*, 400*c*, 400*d*, 400*e*, 400*f*, and 400*g* are respectively welded to the first side wall 200 and the floor 100 (and thus create rigid connections therebetween), but are not welded to the first floor-side-wall connector and thus do not create a rigid connection with the first floor-side-wall connector or increase fatigue issues to these components or areas.

Likewise, the plurality of second side wall support brackets 500*a*, 500*b*, 500*c*, 500*d*, 500*e*, 500*f*, and 500*g* are spaced-apart along the longitudinal length of and adjacent to the outer surfaces of the floor 100 and the second side wall 300 to provide additional support for the floor 100 and the second side wall 300. The second side wall support brackets 500*a*, 500*b*, 500*c*, 500*d*, 500*e*, 500*f*, and 500*g* are not positioned along but rather positioned transversely to the weld connection areas of the floor 100 and the second side wall 300 in this example embodiment. This arrangement limits the amount the unsupported members of the side wall 300 and floor 100 can deflect under load. The second side wall support brackets 500*a*, 500*b*, 500*c*, 500*d*, 500*e*, 500*f*, and 500*g* are identical in this example embodiment, and identical to but reversely positioned relative to the first side wall support brackets 400*a* to 400*g*, so they are not described in detail for brevity. It should thus be appreciated that the first side wall support brackets 500*a*, 500*b*, 500*c*, 500*d*, 500*e*, 500*f*, and 500*g* are respectively welded to the second side wall 300 and the floor 100 (and thus create rigid connections therebetween), but are not welded to the second floor-side-wall connector and thus do not create a rigid connection with the second floor-side-wall connector or increase fatigue issues to these components or areas.

In this example embodiment, the first and second side wall support brackets are made from steel members, wherein each steel member is made from 100 ksi material. In other embodiments, these members can have a yield strength in the range from 50 ksi through 175 ksi. It should be appreciated that the first and second side wall support brackets can be alternatively shaped, sized, and otherwise configured in accordance with the present disclosure, such as but not limited to the alternative examples described below.

The plurality of first side wall end support brackets 450*a* and 450*b* are spaced-apart at the end members of the first side wall 200 to provide additional support for the first side wall 200. The first side end wall support brackets 450*a* and 450*b* are not positioned along but rather positioned transversely to the weld connection areas of the first side wall 200 in this example embodiment, and also centered over or aligned with the connection to the trucks. This enables the support brackets 450*a* and 450*b* to reinforce the weld connection, and provide support during jacking operations. The side wall end support bracket 450*a* is connected to the upwardly extending bracket receiver 54 of first U-shaped body support 50 and includes an outer wall (not labeled) and two inwardly extending inner walls (not labeled). The two inwardly extending inner walls are welded to the outer surface of the first side wall 200 above the floor-side-wall connector (in a similar manner as explained above with respect to support bracket 400*a*). The side wall end support bracket 450*b* is connected to the upwardly extending bracket receiver 64 of first U-shaped body support 60 and includes an outer wall (not labeled) and two inwardly extending inner walls (not labeled). The two inwardly extending inner walls are welded to the outer surface of the first side wall 200 above the floor-side-wall connector (in a similar manner as explained above with respect to support bracket 400*a*).

Likewise, the plurality of second side wall end support brackets 550*a* and 550*b* are spaced-apart at the end members of the second side wall 300 to provide additional support for the second side wall 300. The second side end wall support brackets 550*a* and 550*b* are not positioned along but rather positioned transversely to the weld connection areas of the first side wall 300 in this example embodiment, and also centered over or aligned with the connection to the trucks. This enables the support brackets 450*a* and 450*b* to reinforce the weld connection area, and provide support during jacking operations. The side wall end support bracket 550*a* is connected to the upwardly extending bracket receiver 56 of first U-shaped body support 50 and includes an outer wall (not labeled) and two inwardly extending inner walls (not labeled). The two inwardly extending inner walls are welded to the outer surface of the second side wall 300 (in a similar manner as explained above with respect to support bracket 400*a*). The side wall end support bracket 550*b* is connected to the upwardly extending bracket receiver 66 of second U-shaped body support 60 and includes an outer wall (not labeled) and two inwardly extending inner walls (not labeled). The two inwardly extending inner walls are welded to the outer surface of the second side wall 300 (in a similar manner as explained above with respect to support bracket 400*a*).

In this example embodiment, the first and second side wall end support brackets are made from steel members, wherein each steel member is made from 100 ksi material. In other embodiments, these members can have a yield strength in the range from 50 ksi through 175 ksi. It should be appreciated that the first and second side wall end support brackets can be alternatively shaped, sized, and otherwise configured in accordance with the present disclosure.

Figure 7A:
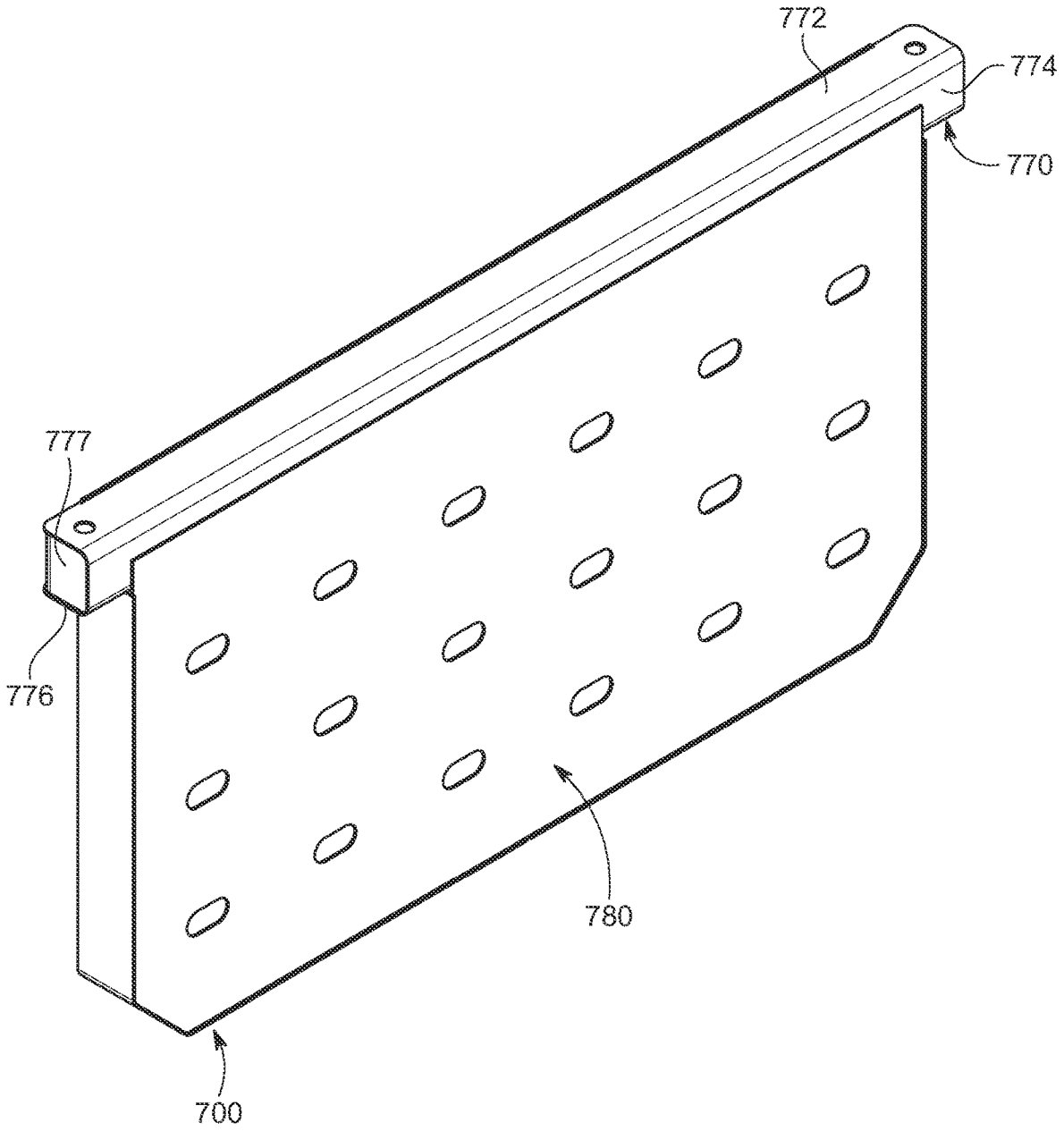
FIG. 7A is an enlarged top perspective outer view of the first end wall of the gondola railroad car of FIG. 1.
Figure 7B:
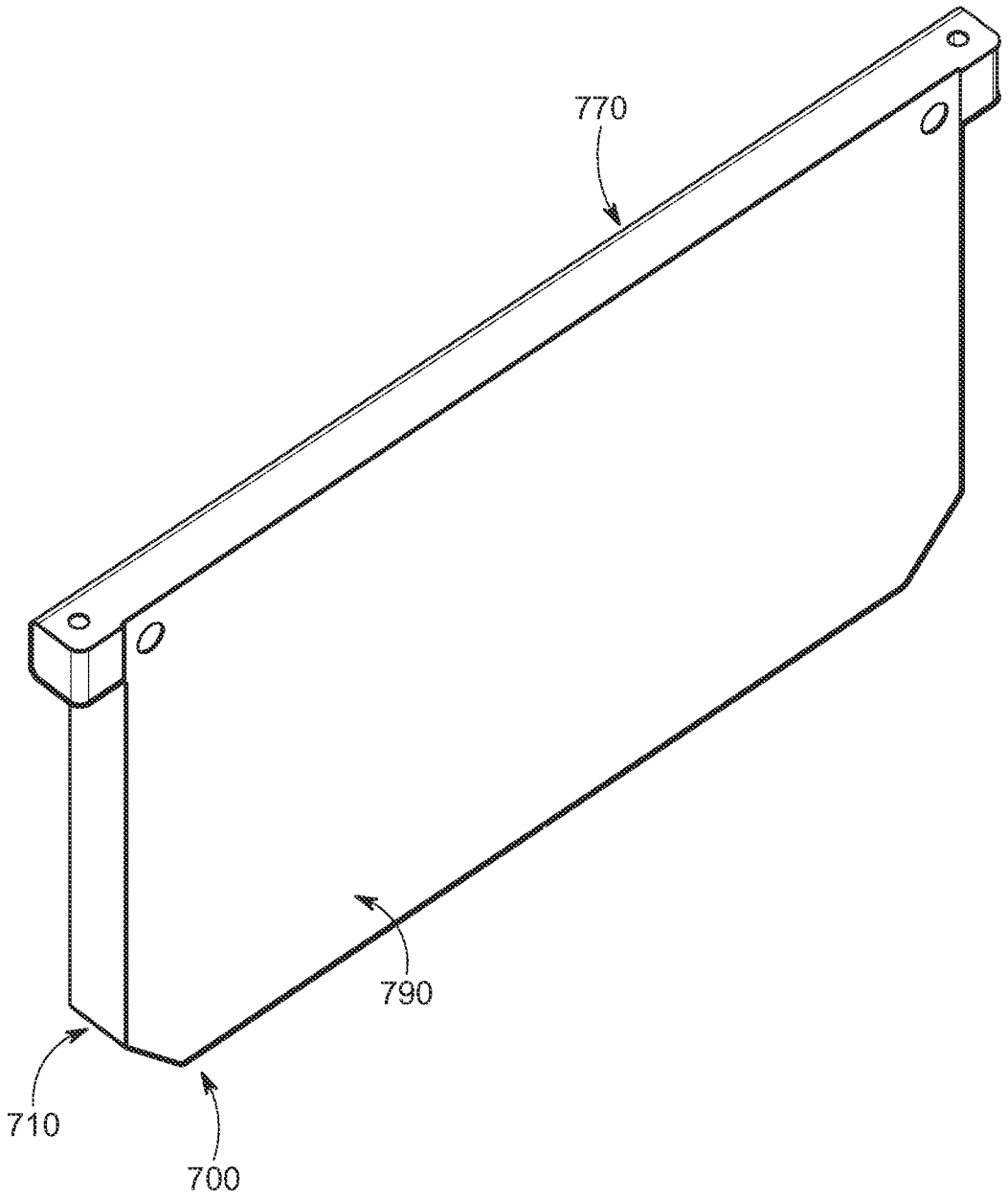
FIG. 7B is an enlarged top perspective inner view of the first end wall of the gondola railroad car of FIG. 1.
Figure 8:
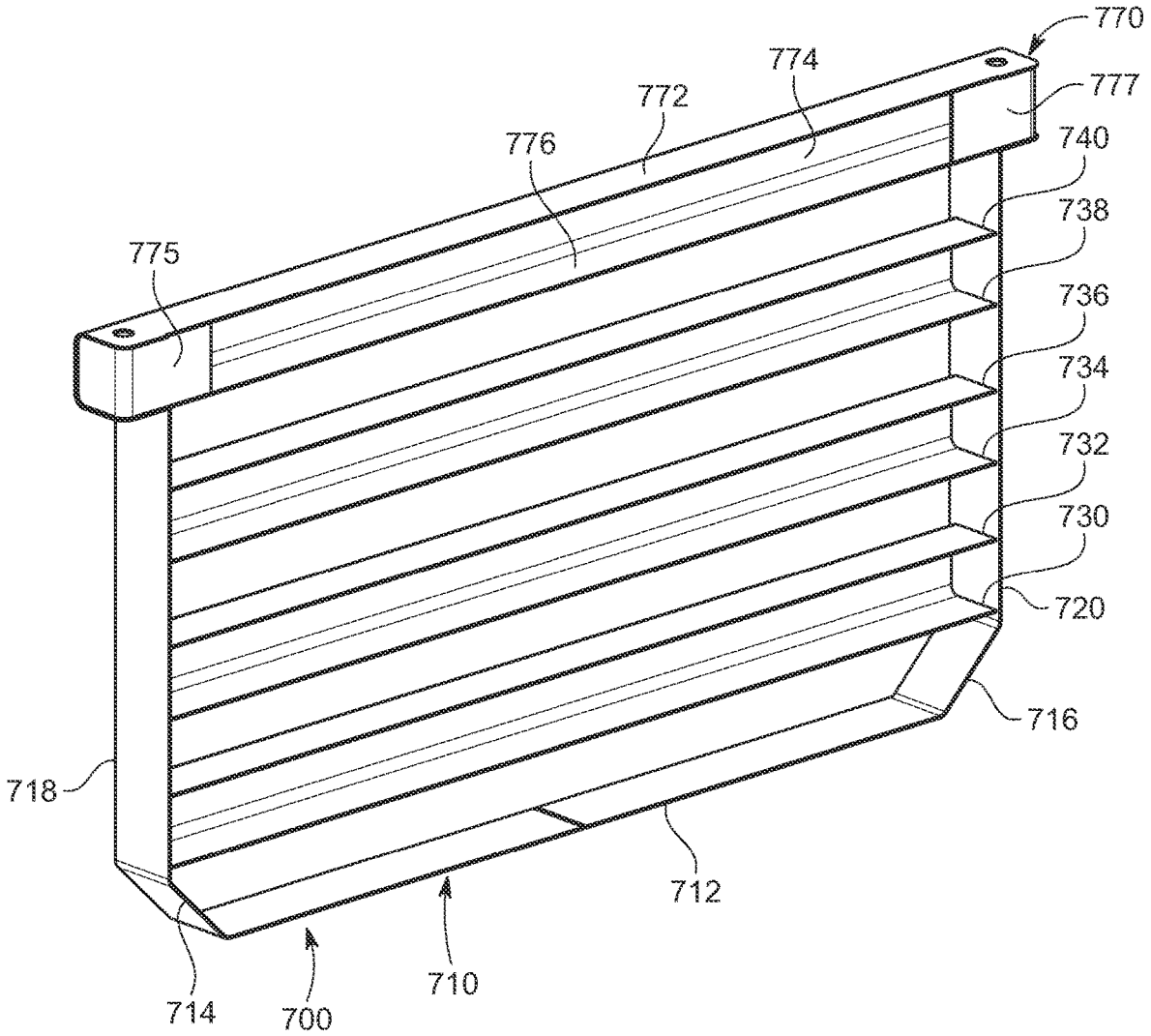
FIG. 8 is an enlarged top perspective outer view of the first end wall of the gondola railroad car of FIG. 1, shown with the outer end plate thereof removed for clarity.

As best shown in FIGS. 7A, 7B, and 8, the first end wall 700 includes a frame 710, an outer panel 780 connected to the frame 710, an inner panel 790 connected to the frame 710, and an upper brace 770 connected to the frame 710. The frame 710 includes an outer generally U-shaped exterior wall including a bottom member 712, first and second corner members 714 and 716 respectively connected to and extending from opposite end of the bottom member 712, first and second side members 718 and 720 respectively connected to and extending from the first and second corner members 714 and 716, and a plurality of spaced apart interior connectors 730, 732, 734, 736, 738, and 740 extending between and connected to the respective spaced-apart interior surfaces of the side members 718 and 720. The upper brace 770 includes an elongated tubular member having a top wall 772, an outer wall 774, a bottom wall 776, a first end member 775, and a second end member 777. The first end wall 700 is connected to the floor 100 and the first and second side walls 200 and 300 by applying welds where the edges of the frame 710 come into contact with the floor 100 and the first and second side walls 200 and 300. In various embodiment, the first end wall 700 is pinned and welded to the first and second floor-side-wall connectors to create a partially rigid connection between such components. In this example embodiment, the first end wall 700 is made from steel members, wherein certain of the steel members have a yield strength in the range from 100 ksi through 175 ksi. In other embodiments, the certain of the steel members of the first end wall 700 have a yield strength of 175 ksi. For example, panels 780 and/or 790 can have a yield strength of 175 ksi. It should be appreciated that the first end wall can be alternatively shaped, sized, and otherwise configured in accordance with the present disclosure. The second end wall 800 is identical to the first end wall 700 in this embodiment and is thus not described in detail for brevity.

Figure 9:
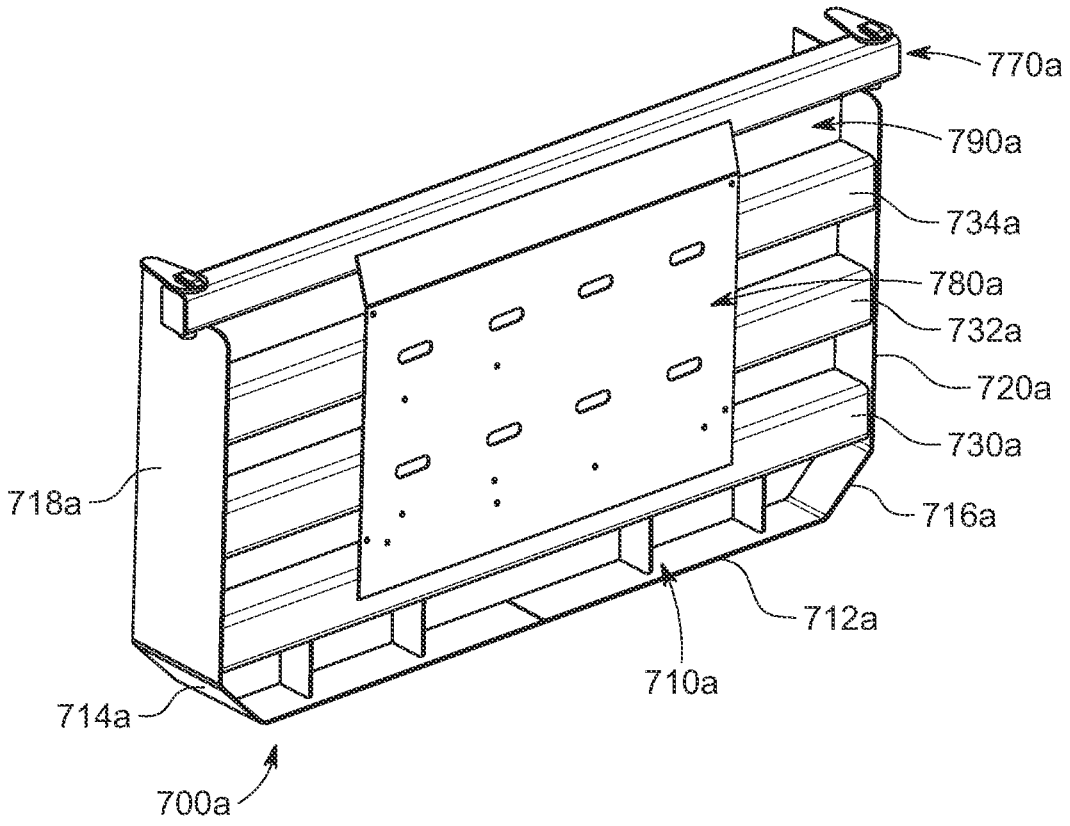
FIG. 9 is an enlarged top perspective outer view of an alternative first end wall of a gondola railroad car of one example embodiment of the present disclosure.
Figure 9A:
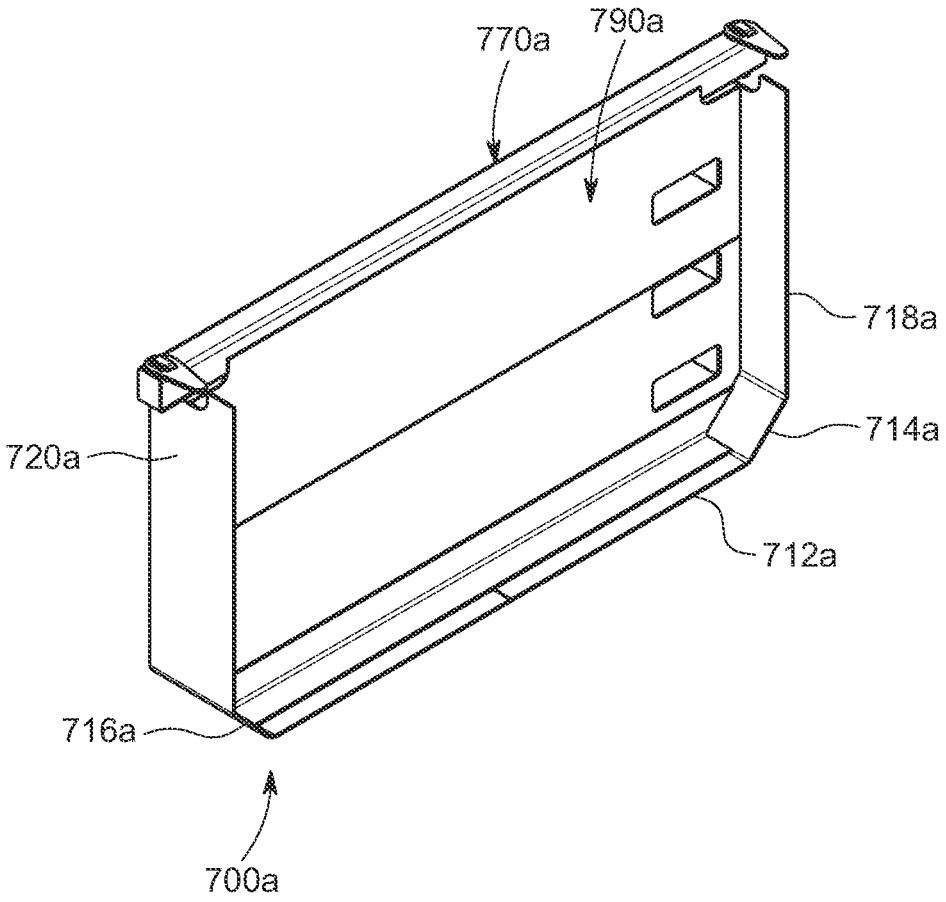
FIG. 9A is an enlarged top perspective inner view of the alternative first end wall of FIG. 9.
Figure 10:
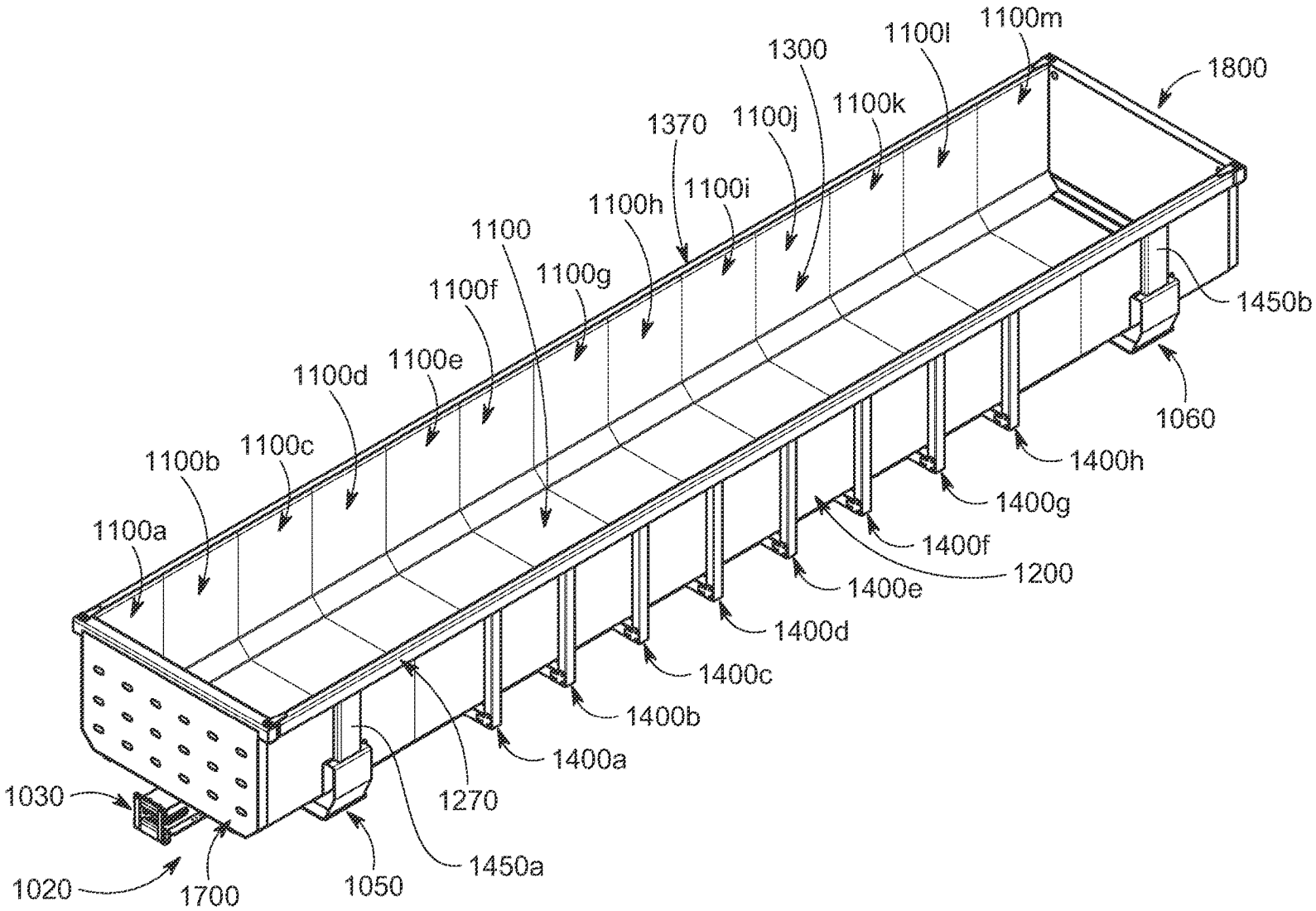
FIG. 10 is a top perspective view of a gondola railroad car of another example embodiment of the present disclosure, shown without the trucks and wheels of the gondola railroad car and including transversely extending high strength steel members.
Figure 11:
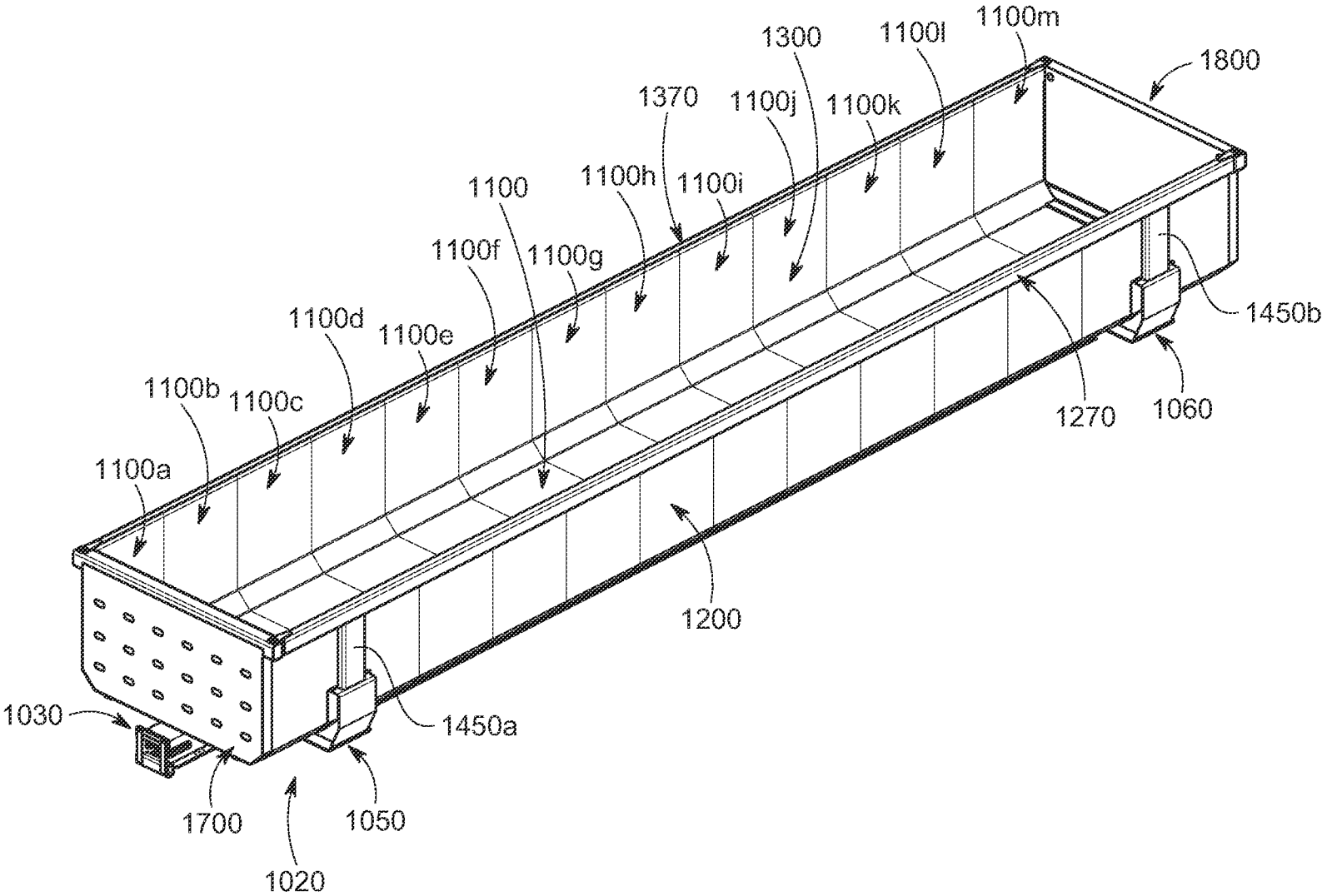
FIG. 11 is a top perspective view of the gondola railroad car of FIG. 10, shown without the first side wall support brackets that have been removed for clarity, and shown without the trucks and wheels of the gondola railroad car.

An alternative first end wall in accordance with the present disclosure is shown in FIGS. 9 and 9A. This alternative first end wall 700*a* includes a frame 710*a*, an outer panel 780*a* connected to the frame 710*a*, an inner panel 790*a* connected to the frame 710*a*, and an upper brace 770*a* connected to the frame 710*a*. The frame 710*a* includes an outer generally U-shaped exterior wall including a bottom member 712*a*, first and second corner members 714*a* and 716*a* respectively connected to and extending from opposite end of the bottom member 712*a*, first and second side members 718*a* and 720*a* respectively connected to and extending from the first and second corner members 714*a* and 716*a*, and a plurality of spaced apart interior connectors 730*a*, 732*a*, and 734*a* extending between and connected to the respective spaced-apart interior surfaces of the side members 718*a* and 720*a*. In various embodiments, the first end wall 700*a* is connected to the floor 100 and the first and second side walls 200 and 300 by applying welds where the edges of the frame 710*a* come into contact with the floor 100 and the first and second side walls 200 and 300. In various embodiments, the first end wall 700*a* is pinned and welded to the first and second floor-side-wall connectors to create a partially rigid connection between such components. In various embodiments, portions of the U-shaped exterior wall including first and second corner members 714*a* and 716*a* and the first and second side members 718*a* and 720*a* overlap the respective portions of the side walls 200 and 300 (and connections areas thereof) to reinforce end portions of those side walls. In this example embodiment, the first end wall 700 is made from steel members, wherein certain of the steel members have a yield strength in the range from 100 ksi through 175 ksi. In other embodiments, the certain of the steel members of the first end wall 700*a* have a yield strength of 175 ksi. For example, panels 780*a* and/or 790*a* can have a yield strength of 175 ksi. In this example, the outer generally U-shaped exterior wall of frame 710*a* can also have a yield strength of 175 ksi. It should be appreciated that the first end wall can be alternatively shaped, sized, and otherwise configured in accordance with the present disclosure. In this alternative embodiment, the second end wall on the opposite side of the gondola railroad car can be identical to this alternative first end wall 700*a* and is thus not described in detail for brevity.

FIGS. 10, 11, 12, and 13 illustrate certain components of a gondola railroad car 1020 of a second example embodiment of the present disclosure. This gondola railroad car 1020 includes: (1) a frame 1030; (2) spaced apart trucks (not shown) configured to support the frame 1030; and a (3) a plurality of sets of wheels (not shown) that respectively support the trucks. This gondola railroad car 1020 also includes a containment structure 1100 including: (4) a plurality of transversely extending connected U-shaped high strength steel and particularly ultra-high strength steel members such as members 1100*a* to 1100*m* that are welded together along respective spaced-apart transverse weld connection areas (not labeled) that each connect pairs of adjacent members; (5) a first end wall 1700 connected to one of the end members such as end member 1100*a*; and (6) a second end wall 1800 connected to another one of the end members such as member 1100*m*. In this example embodiment, the connected U-shaped members such as members 1100*a* to 1100*m* for the floor, the first side wall, the second side wall, the first floor-side-wall connector, and the second floor-side-wall connector. This gondola railroad car 20 further includes a containment support assembly including: (7) a plurality of spaced-apart first side wall support brackets 1400*a*, 1400*b*, 1400*c*, 1400*d*, 1400*e*, 1400*f*, 1400*g*, and 1400*h* connected to and extending upwardly from the frame 1030 and connected to the first side wall of containment structure 1100; (8) a pair spaced-apart first side wall end support brackets 1450*a* and 1450*b* connected to and extending upwardly from the frame 1030 and connected to the first side wall of containment structure 1100; (9) a plurality of spaced-apart second side wall support brackets 1500*a*, 1500*b*, 1500*c*, 1500*d*, 1500*e*, 1500*e*, 1500*f*, 1500*g*, and 1500*h* connected to and extending upwardly from the frame 1030 and connected to the second side wall of containment structure 1100; and (10) a pair spaced-apart second side wall end support brackets 1550*a* and 1550*b* connected to and extending upwardly from the frame 1030 and connected to the second side wall of containment structure 1100.

Figure 12:
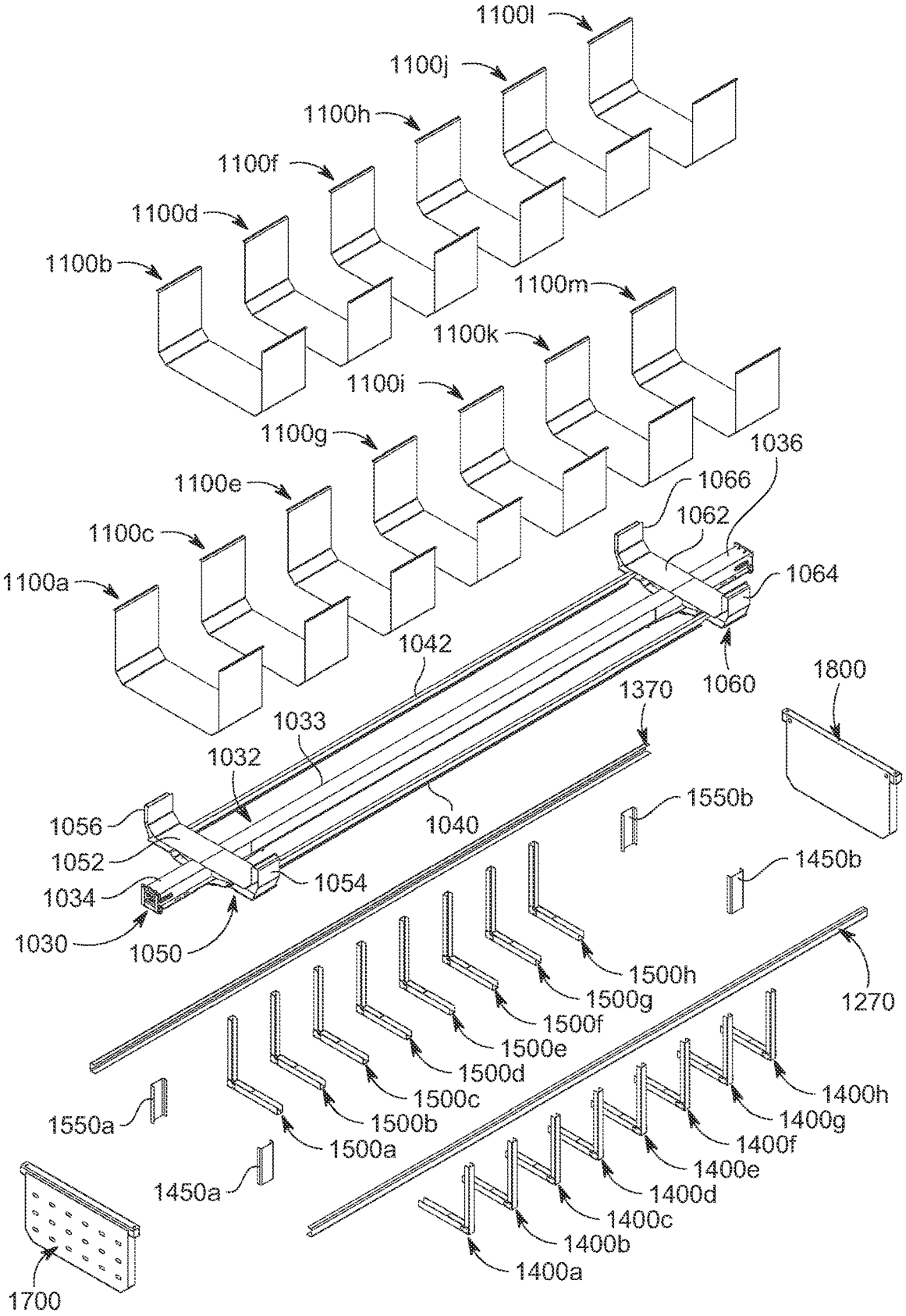
FIG. 12 is a top perspective exploded view of the gondola railroad car of FIG. 10 with certain components removed, and shown without the trucks and wheels of the gondola railroad car.

Like frame 30 described above, the frame 1030 includes an elongated longitudinally extending center sill 1032 that includes a longitudinally extending central member 1033, a longitudinally extending first stub sill assembly 1034 at a first end of the center sill 1032, and a longitudinally extending second stub sill assembly 1036 at the opposite second end of the center sill 1032, as best shown in FIG. 12. The frame 30 also includes a first U-shaped body support 1050 connected to and extending transversely from the center sill 1032 and a second U-shaped body support 1060 connected to and extending transversely from the center sill 1032. The first U-shaped body support 1050 includes a transversely extending base 1052 and spaced-apart upwardly extending bracket receivers 1054 and 1056 connected to opposite transverse ends of the base 1052. Likewise, the second U-shaped body support 1060 includes a transversely extending base 1062 and spaced-apart upwardly extending bracket receivers 1064 and 1066 connected to opposite transverse ends of the base 1062. The frame 1030 further includes an elongated longitudinally extending first side floor support 1040 spaced from the center sill 1032 and an elongated longitudinally extending second side floor support 1042 spaced from the center sill 1032. The first side floor support 1040 is connected to and extends between the base 1052 of the first U-shaped body support 1050 and the base 1062 of the second U-shaped body support 60 on a first side of the center sill 1032. The second side floor support 1042 is connected to and extends between the base 1052 of the first U-shaped body support 1050 and the base 1062 of the second U-shaped body support 1060 on a second side of the center sill 1032.

In this example embodiment, the frame 1030 is made from steel members, wherein each steel member has a yield strength in the range from 65 ksi through 100 ksi. It should be appreciated that the frame can be alternatively shaped, sized, and otherwise configured in accordance with the present disclosure.

In this example embodiment, as mentioned above, the containment structure 1100 is formed from thirteen connected U-shaped ultra-high strength steel members 1100*a* to 1100*m* that are welded together along respective spaced-apart transverse weld connection areas (not labeled) that each connect pairs of adjacent members. In this example embodiment, each of the members 1100*a* to 1100*m* is a single transversely extending member of high strength steel and particularly ultra-high strength steel having a yield strength of 175 ksi. In certain such embodiments, the width of each of the connected members 1100*a* to 1100*m* employed to form part of the floor 1100, part of the first side wall 1200, part of the second side wall 1300, part of the first floor-side-wall connector, and part of the second floor-side-wall connector is equal to the width of the steel coil used to form such member. It should be appreciated that the quantity of such members can vary in accordance with the present disclosure. The members 1100*a* to 1100*m* are identical in this example embodiment, so only member 1100*a* is described in detail for brevity.

Figure 13:
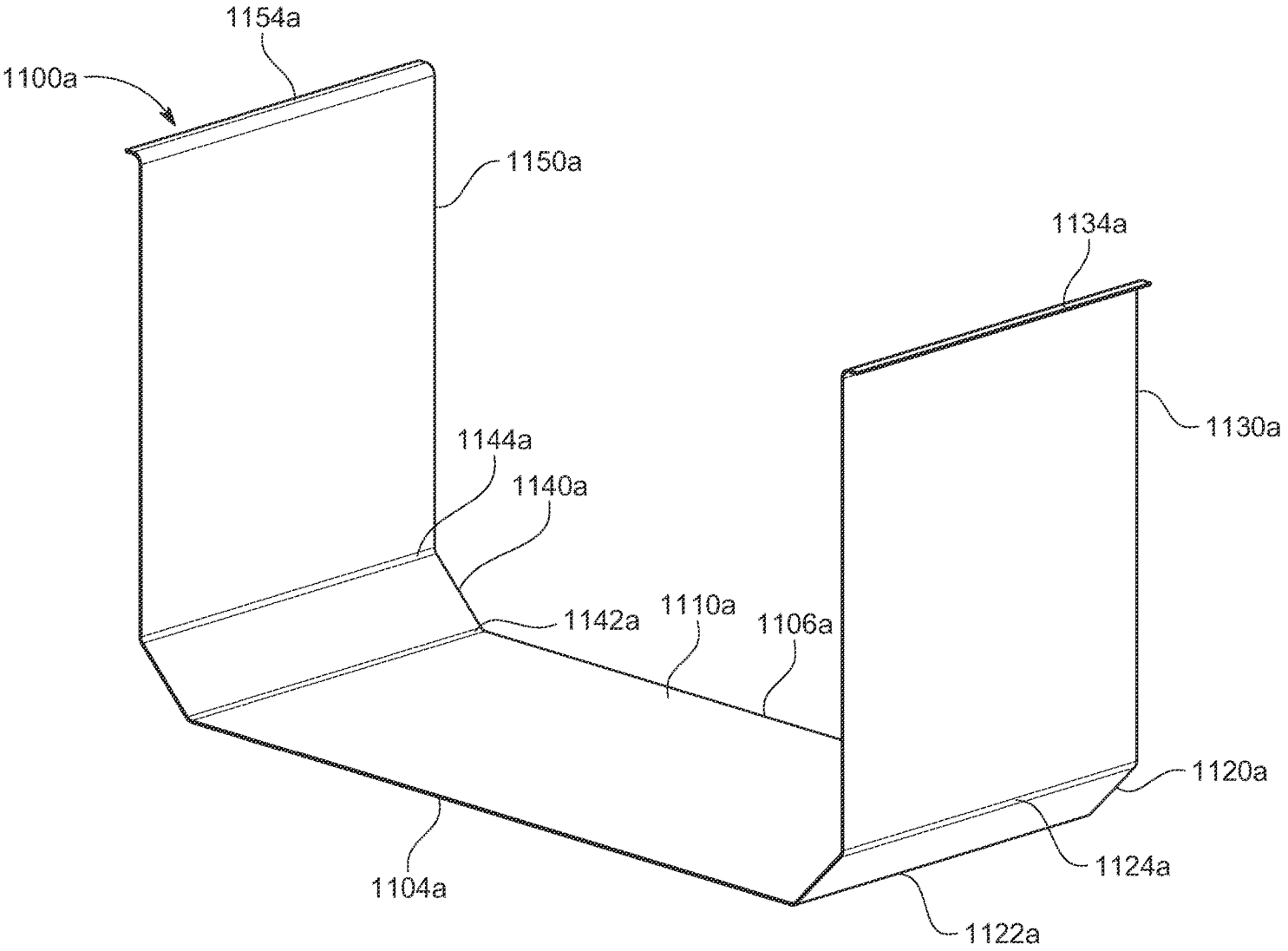
FIG. 13 is a top perspective view of a member of the gondola railroad car of FIG. 10 that functions as part of the floor, part of the first side wall, and part of the second side wall of the gondola railroad car.

As best shown in FIG. 13, member 1100*a* includes: (1) a substantially flat and horizontally or substantially horizontally extending bottom member 1110*a*; (2) a substantially flat and vertically or substantially vertically extending first upper member 1130*a*; (3) a substantially flat and angled upwardly extending first connection member 1120*a* between the bottom member 1110*a* and the first upper member 1130*a*; (4) a first lower bend 1122*a* connecting the first connection member 1120*a* and the bottom member 1110*a*; (5) a first upper bend 1124*a* connecting the first connection member 1120*a* and the first upper member 1130*a*; (6) a substantially flat and vertically or substantially vertically extending second upper member 1150*a*; (7) a substantially flat and angled upwardly extending second connection member 1140*a* that between the bottom member 1110*a* and the second upper member 1150*a*; (8) a second lower bend 1142*a* connecting the second connection member 1140*a* and the bottom member 1110*a*; and (9) a second upper bend 1144*a* connecting the second connection member 1120*a* and the second upper member 1150*a*. The longitudinally extending bends 1122*a*, 1124*a*, 1142*a*, and 1144*a* are each at approximately 45 degrees, although the amount of angularity can vary in accordance with the present disclosure. The substantially flat and vertically or substantially vertically extending first upper member 1130*a* includes an upper outwardly curved lip 1134*a*. The substantially flat and vertically or substantially vertically extending second upper member 1150*a* includes an upper outwardly curved lip 1154*a*. The member 1100*a* includes a first edge 1104*a* and an opposite edge a second edge 1106*a*. The edge 1104*a* is configured to be welded to the first edge (not labeled) of member 1100*b* along a weld connection area (not labeled) to connect member 1100*a* to member 1100*b*. In a like manner, all of the members 1100*a* to 1100*m* are thus connected to form the containment structure 1100, the first side wall 1200, the second side wall 1300, the first floor-side-wall connector, and the second floor-side-wall connector. In this example embodiment, a lower part of the first upper member 1130*a*, the first connection member 1120*a*, an outer part of the bottom member 1110*a*, the first lower bend 1122*a*, and the first upper bend 1124*a* form the first floor-side-wall connector. Likewise, in this example embodiment, a lower part of the second upper member 1150*a*, the second connection member 1140*a*, an outer part of the bottom member 1110*a*, the second lower bend 1142*a*, and the second upper bend 1144*a* form the second floor-side-wall connector. The longitudinally extending bends 1122*a*, 1124*a*, 1142*a*, and 1144*a* are each at approximately 45 degrees, although they can vary in accordance with the present disclosure. The substantially flat and vertically or substantially vertically extending first upper member 1130*a* includes an upper outwardly curved lip 1134*a*. The substantially flat and vertically or substantially vertically extending second upper member 1150*a* includes an upper outwardly curved lip 1154*a*. The member 1100*a* includes a first edge 1104*a* and an opposite edge a second edge 1106*a*. The edge 1104*a* is configured to be welded to the first edge (not labeled) of member 1100*b* along a weld connection area (not labeled) to connect member 1100*a* to member 1100*b*. In a like manner, all of the members 1100*a* to 1100*m* are thus connected to form the containment structure 1100, the first side wall 1200, and the second side wall 1300.

It should thus be appreciated that the containment structure 1100 (which in this example includes thirteen connected members) is partially formed multiple transverse members that together extends substantially the length of the car 1020 from the first end wall 1700 to the second end wall 1800. The containment structure 1100 is connected to the frame 1030 by a plurality of welds (not shown) between the bottom surfaces of the bottom members (such as bottom member 1110*a*) of members 1100*a* to 1100*m* and (i) the central member 1033 of the center sill 1032, (ii) the base 1052 of the first U-shaped body support 1050, (iii) the base 1062 of the second U-shaped body support 1060, (iv) the first side floor support 1040, and (v) the second side floor support 1042.

The first side wall 1200 can further include an elongated longitudinally extending upper brace 1270 connected to the upper portions of the members 1100*a* to 1100*m*. The upper brace 1270 includes an elongated tubular member and is welded to the upper ends of the members 1100*a* to 1100*m* such that the upper brace 1270 forms part of the upper rim of the railroad car 1020. In this example embodiment, the upper brace 1270 made from a steel member having a yield strength of 100 ksi. In other embodiments, upper brace 1270 has a yield strength in the range from 100 ksi through 175 ksi. It should be appreciated that the upper brace 1270 can be alternatively shaped, sized, and otherwise configured in accordance with the present disclosure Likewise, the second side wall 1300 includes an elongated longitudinally extending upper brace 1370 to the upper portions of the members 1100*a* to 1100*m*. The upper brace 1370 includes an elongated tubular member and is welded to the upper ends of the upper portions of the members 1100*a* to 1100*m* such that the upper brace forms 1370 part of the upper rim of the railroad car 1020. In this example embodiment, the upper brace 1370 made from a steel member having a yield strength of 100 ksi. In other embodiments, upper brace 1370 has a yield strength in the range from 100 ksi through 175 ksi. It should be appreciated that the upper brace 370 can be alternatively shaped, sized, and otherwise configured in accordance with the present disclosure.

In various embodiments, the containment structure 1100 can include one or more elongated side wall reinforcement members (not shown). Each of these reinforcement members can be intermittent or can extend the entire length of the containment structure 1100.

In various embodiments, the end transverse members such as members 1100*a* and 1100*m* are each thicker than the members 1100*b* to 1100*l* there between. These increased or greater thickness members provide additional strength and support during longitudinal loading on the end walls 700 and 800.

The plurality of first side wall support brackets 1400*a*, 1400*b*, 1400*c*, 1400*d*, 1400*e*, 1400*f*, 1400*g*, and 1400*h* are spaced-apart along the length of and adjacent to the outer surfaces of the floor 1100 and the first side wall 1200 to provide additional support for the floor 1100 and the first side wall 1200. The first side wall support brackets 1400*a*, 1400*b*, 1400*c*, 1400*d*, 1400*e*, 1400*f*, 1400*g*, and 1400*h* are positioned along and are aligned with certain of the weld connection areas of the members 1100*a* to 1100*m* in this example embodiment to provide additional support at those weld connection areas. The first side wall support brackets 1400*a*, 1400*b*, 1400*c*, 1400*d*, 1400*e*, 1400*f*, 1400*g*, and 1400*h* are identical in this example embodiment, and also identical to first side wall support bracket 400*a* described above, so the side wall support bracket 1400*a* to 1400*h* are not described in detail for brevity. It should be appreciated as described above that for this example that the first side wall support brackets 1400*a*, 1400*b*, 1400*c*, 1400*d*, 1400*e*, 1400*f*, 1400*g*, and 1400*h* are respectively welded to the first side wall 1200 and the floor 1100 (and thus create rigid connections between such members), but are not welded to the first floor-side-wall connector as described above and thus do not create a rigid connection with the first floor-side-wall connector.

Likewise, the plurality of second side wall support brackets 1500*a*, 1500*b*, 1500*c*, 1500*d*, 1500*e*, 1500*f*, 1500*g*, and 1500*h* are spaced-apart along the length of and adjacent to the outer surfaces of the floor 1100 and the second side wall 1300 to provide additional support for the floor 1100 and the second side wall 1300. The second side wall support brackets 1500*a*, 1500*b*, 1500*c*, 1500*d*, 1500*e*, 1500*f*, 1500*g*, and 1500*h* are positioned along and are aligned with certain of the weld connection areas of the members 1100*a* to 1100*m* in this example embodiment to provide additional support at those weld connection areas. The second side wall support brackets 1500*a*, 1500*b*, 1500*c*, 1500*d*, 1500*e*, 1500*f*, 1500*g*, and 1500*h* are identical in this example embodiment, and also identical to first side wall support bracket 400*a* described above, so the side wall support bracket 1500*a* to 1500*h* are not described in detail for brevity. It should be appreciated as described above that for this example that the first side wall support brackets 1500*a*, 1500*b*, 1500*c*, 1500*d*, 1500*e*, 1500*f*, 1500*g*, and 1500*h* are respectively welded to the second side wall 1300 and the floor 1100 (and thus create rigid connections therebetween), but are not welded to the second floor-side-wall connector as described above and thus do not create a rigid connection with the second floor-side-wall connector.

In this example embodiment, the first and second side wall support brackets are made from steel members, wherein each steel member is made from 100 ksi material. In other embodiments, these members can have a yield strength in the range from 65 ksi through 175 ksi. It should be appreciated that the first and second side wall support brackets can be alternatively shaped, sized, and otherwise configured in accordance with the present disclosure, such as but not limited to the alternative examples described below.

The first side wall end support brackets 1450*a* and 1450*b* are spaced-apart at the end members of the first side wall 1200 to provide additional support for the first side wall 1200. The first side end wall support brackets 1450*a* and 1450*b* are positioned along respective weld connection areas between members 1100*a* and 1100*b* and between 1100*l* and 1100*m*. The side wall end support bracket 1450*a* is connected to the upwardly extending bracket receiver 1054 of first U-shaped body support 1050 and includes an outer wall (not labeled) and two inwardly extending inner walls (not labeled). The two inwardly extending inner walls are welded to the outer surfaces of the members 1100*a* and 1100*b*. The side wall end support bracket 1450*b* is connected to the upwardly extending bracket receiver 1064 of first U-shaped body support 1060 and includes an outer wall (not labeled) and two inwardly extending inner walls (not labeled). The two inwardly extending inner walls are welded to the outer surfaces of the members 1100*l* and 1100*m*.

Likewise, the second side wall end support brackets 1550*a* and 1550*b* are spaced-apart at the end members of the second side wall 1300 to provide additional support for the second side wall 1300. The second side end wall support brackets 1550*a* and 1550*b* are positioned along weld connection areas between members 1100*a* and 1100*b* and between 1100*l* and 1100*m*. The side wall end support bracket 1550*a* is connected to the upwardly extending bracket receiver 1056 of first U-shaped body support 1050 and includes an outer wall (not labeled) and two inwardly extending inner walls (not labeled). The two inwardly extending inner walls are welded to the outer surfaces of members 1100*a* and 1100*b*. The side wall end support bracket 1550*b* is connected to the upwardly extending bracket receiver 1066 of second U-shaped body support 1060 and includes an outer wall (not labeled) and two inwardly extending inner walls (not labeled). The two inwardly extending inner walls are welded to the outer surfaces of members 1100*l* and 1100*m*.

In this example embodiment, the first and second side wall end support brackets are made from steel members, wherein each steel member has a yield strength of 100 ksi. In other embodiments, these members can have a yield strength in the range from 65 ksi through 175 ksi. It should be appreciated that the first and second side wall end support brackets can be alternatively shaped, sized, and otherwise configured in accordance with the present disclosure.

The first end wall 1700 and the second end wall are identical or similar to either of the end walls 700 or 700*a* described above and are thus not described herein for brevity.

Figure 14:
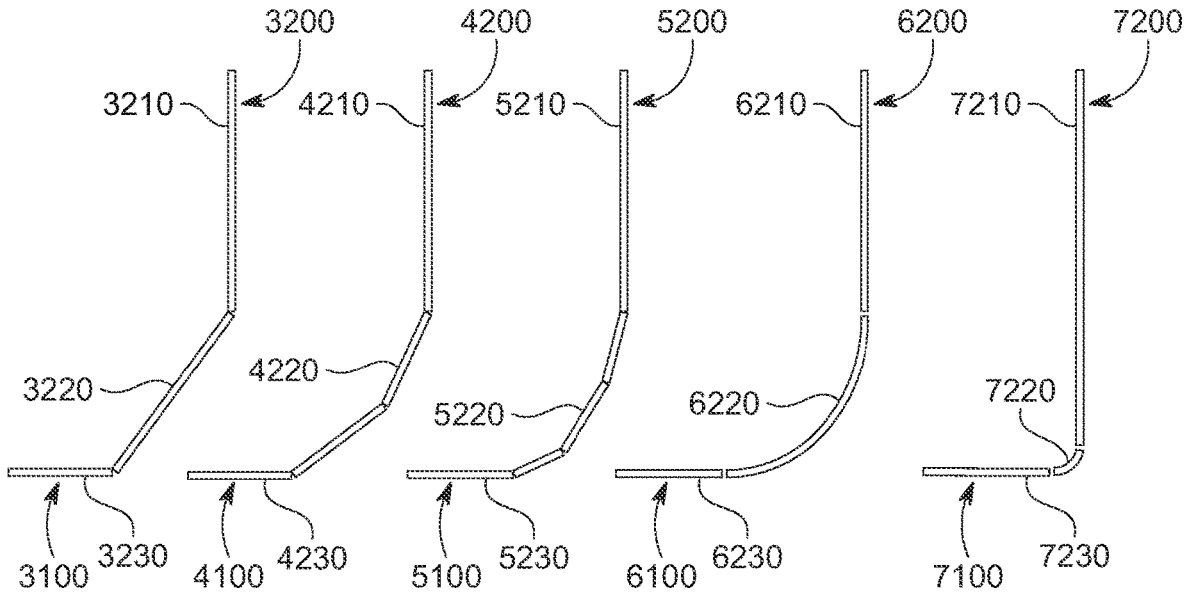
FIG. 14 is a side view of a plurality of alternative bends that can be employed for the members that form the floor and either side wall of the gondola railroad car of the present disclosure.

FIG. 14 illustrates alternative floor-side-wall connector configurations for the gondola railroad car in accordance with the present disclosure. More specifically, FIG. 14 illustrates five different example alternative configurations for the floor-side-wall connector. In each of these alternative configurations, the floor, the side wall, and the floor-side-wall connector are formed from an ultra-high strength steel and particularly ultra-high strength steel having a yield strength of 175 ksi.

More specifically, the first example alternative configuration 3100 includes a floor 3230, a side wall 3200, and a floor-side-wall connector that includes a single connection member 3220 connecting the floor 3230 to upper member 3210 of the side wall 3200. This floor-side-wall connector also includes two bends (not labeled).

The second example alternative configuration 4100 includes a floor 4230, a side wall 4200, and a floor-side-wall connector that includes two connection members 4220 connecting the floor 4230 to upper member 4210 of the side wall 4200. This floor-side-wall connector includes three bends (not labeled).

The third example alternative configuration 5100 includes a floor 5230, a side wall 5200, and a floor-side-wall connector that includes three connection members 5220 connecting the floor 5230 to upper member 5210 of the side wall 5200. This floor-side-wall connector includes four bends (not labeled).

The fourth example alternative configuration 6100 includes a floor 6230, a side wall 6200, and a floor-side-wall connector that includes a single curved connection member 6220 connecting the floor 6230 to upper member 3210 of the side wall 3200. The floor-side-wall connector includes the curved member that forms the single bend.

The fifth example alternative configuration 7100 includes a floor 7230, a side wall 7200, and a floor-side-wall connector that includes a single relatively smaller curved connection member 7220 connecting the floor 7230 to upper member 7210 of the side wall 7200. This floor-side-wall connector includes the curved member that forms the single bend.

FIGS. 15, 16, 17, 18, 19, 20, 21, 22, 23, and 24 illustrate example alternative embodiments of the side wall support bracket configurations for the gondola railroad car in accordance with the present disclosure. More specifically, FIGS. 15 to 24 illustrate eight different example alternative configurations for the side wall support brackets. In these example embodiments, the side wall support brackets are made from steel members, wherein each steel member is made from 100 ksi material. In other embodiments, these members can have a yield strength in the range from 65 ksi through 100 ksi. In all of these embodiments, these side wall support brackets include a non-rigid corner support connecting the respective side wall and floor supports. In all of these embodiments, these side wall support brackets provide a non-rigid corner support for supporting a respective area of a floor-side-wall connector in a non-rigid manner, wherein the floor-side-wall connector is not rigidly connected (such as by welding) to the non-rigid corner support connecting the side wall and floor supports.

Figure 15:
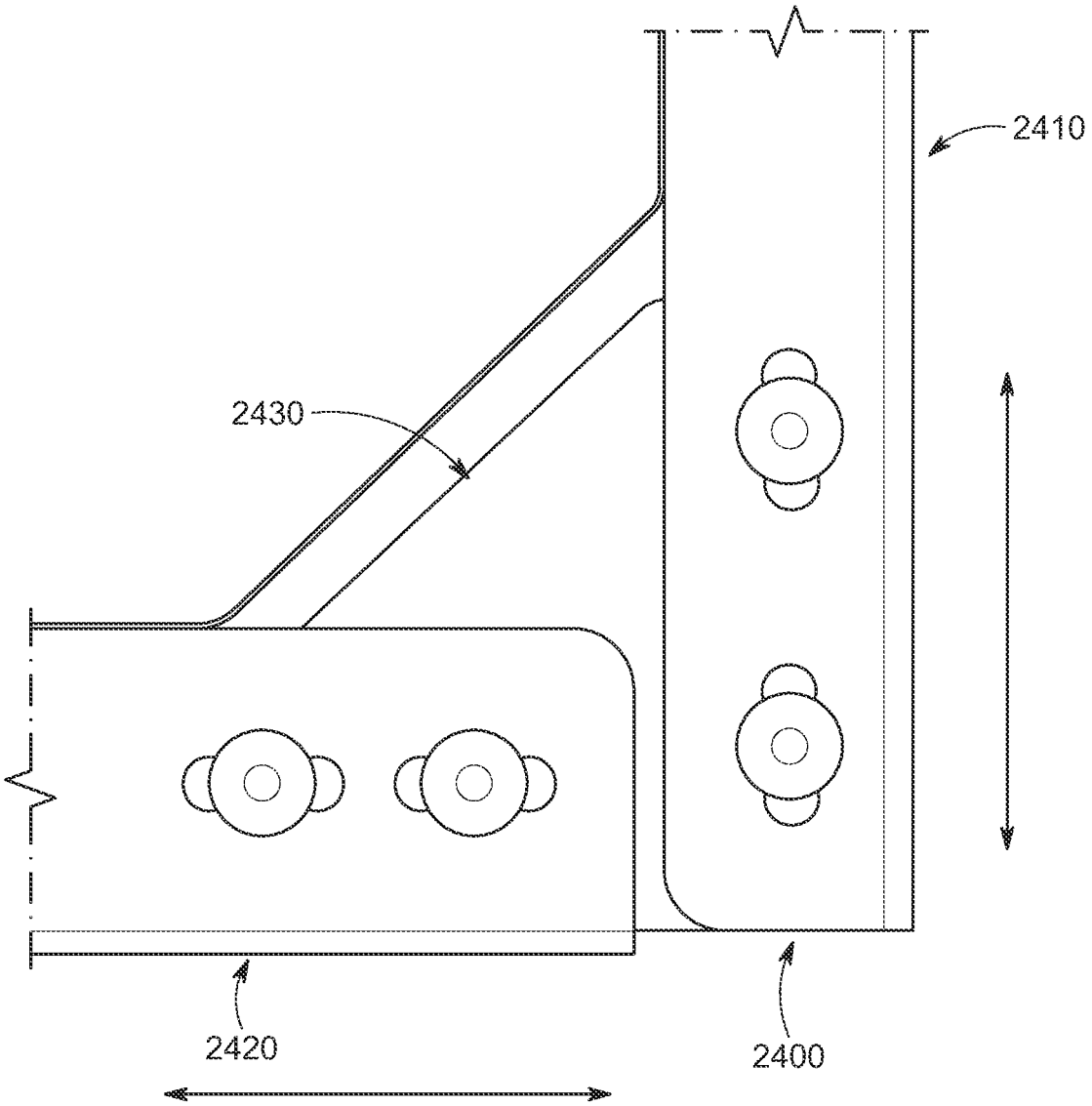
FIG. 15 is a side view of a side wall support bracket that can be employed in a gondola railroad car of another example embodiment of the present disclosure.

FIG. 15 illustrates a first example alternative side wall support bracket 2400 that includes an upwardly vertically extending side wall support 2410, an outwardly horizontally extending floor support 2420, and a corner support 2430 connecting the lower portion of the side wall support 2410 to the outer portion of floor support 2420. The corner support 2430 includes two spaced-apart plates (one of which is shown) and four fasteners (not labeled) (such as bolts and nuts) connecting the plates to the side wall support 2410 and the floor support 2420. The side wall support 2410 and the floor support 2420 include oval vertical and lateral adjustment slots for the fasteners. The side wall support 2410 includes a U-shaped member including an outer wall (not labeled) and two inwardly extending inner walls (not labeled). The two inwardly extending inner walls are weldable to the outer surface of the side wall. Likewise, the floor support 2420 includes a U-shaped member including an outer wall (not labeled) and two inner walls (not labeled) extending upwardly from the outer wall and weldable to the bottom outer surface of the floor. The corner support 2430 is configured to be mechanically fastened rather than being welded or otherwise rigidly connected to the floor-side-wall connector.

Figure 16:
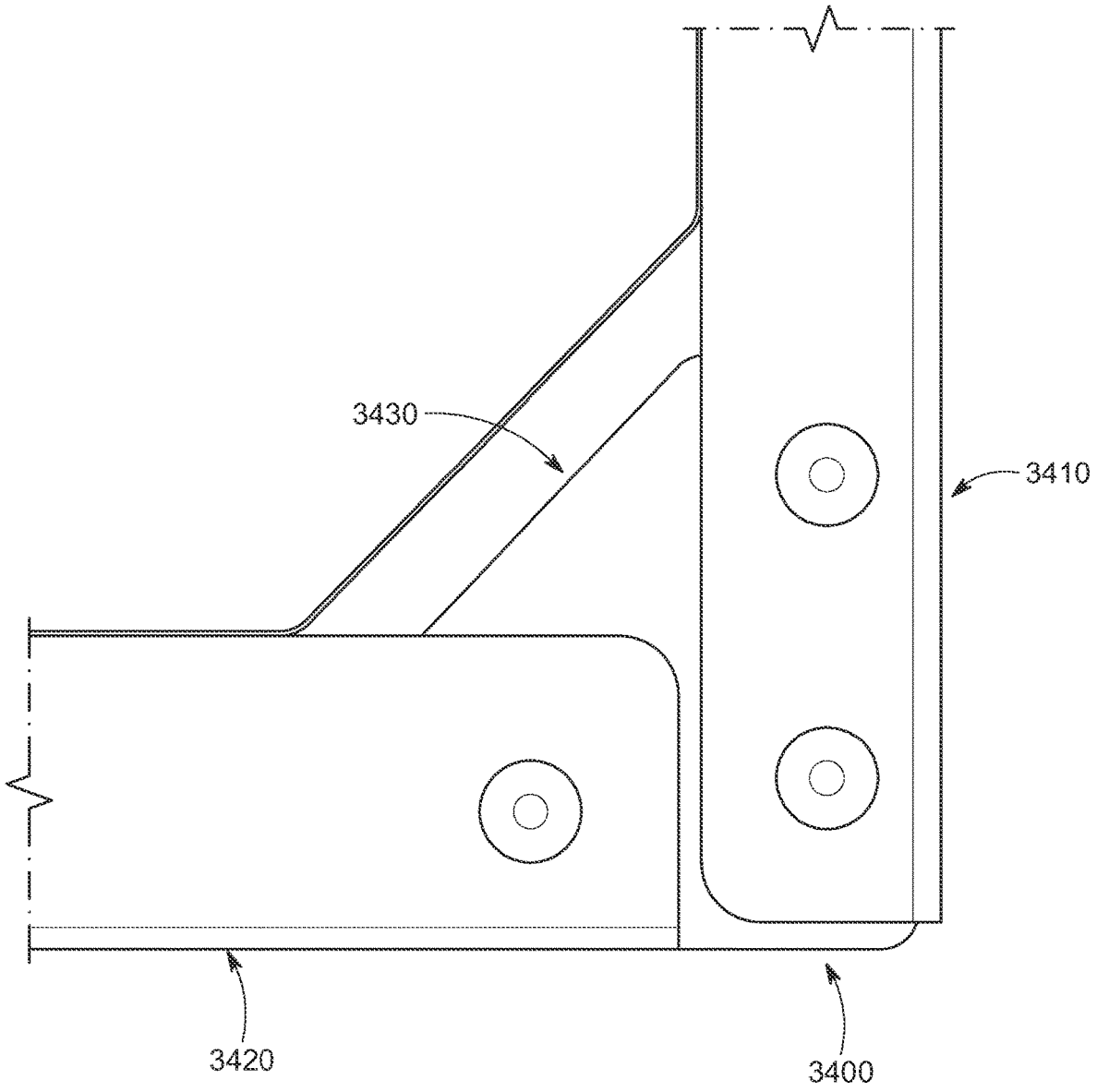
FIG. 16 is a side view of a side wall support bracket that can be employed in a gondola railroad car of another example embodiment of the present disclosure.

FIG. 16 illustrates a second example alternative side wall support bracket 3400 that includes an upwardly vertically extending side wall support 3410, an outwardly horizontally extending floor support 3420, and a corner support 3430 connecting the lower portion of the side wall support 3410 to the outer portion of floor support 3420. The corner support 3430 includes two spaced-apart plates (one of which is shown) and three fasteners (not labeled) (such as bolts and nuts) connecting the plates to the side wall support 3410 and the floor support 3420. The side wall support 3410 includes a U-shaped member including an outer wall (not labeled) and two inwardly extending inner walls (not labeled). The two inwardly extending inner walls are weldable to the outer surface of the side wall. Likewise, the floor support 3420 includes a U-shaped member including an outer wall (not labeled) and two inner walls (not labeled) extending upwardly from the outer wall and weldable to the bottom outer surface of the floor. The corner support 3430 is configured to be mechanically fastened rather than being welded or otherwise rigidly connected to the floor-side-wall connector.

Figure 17:
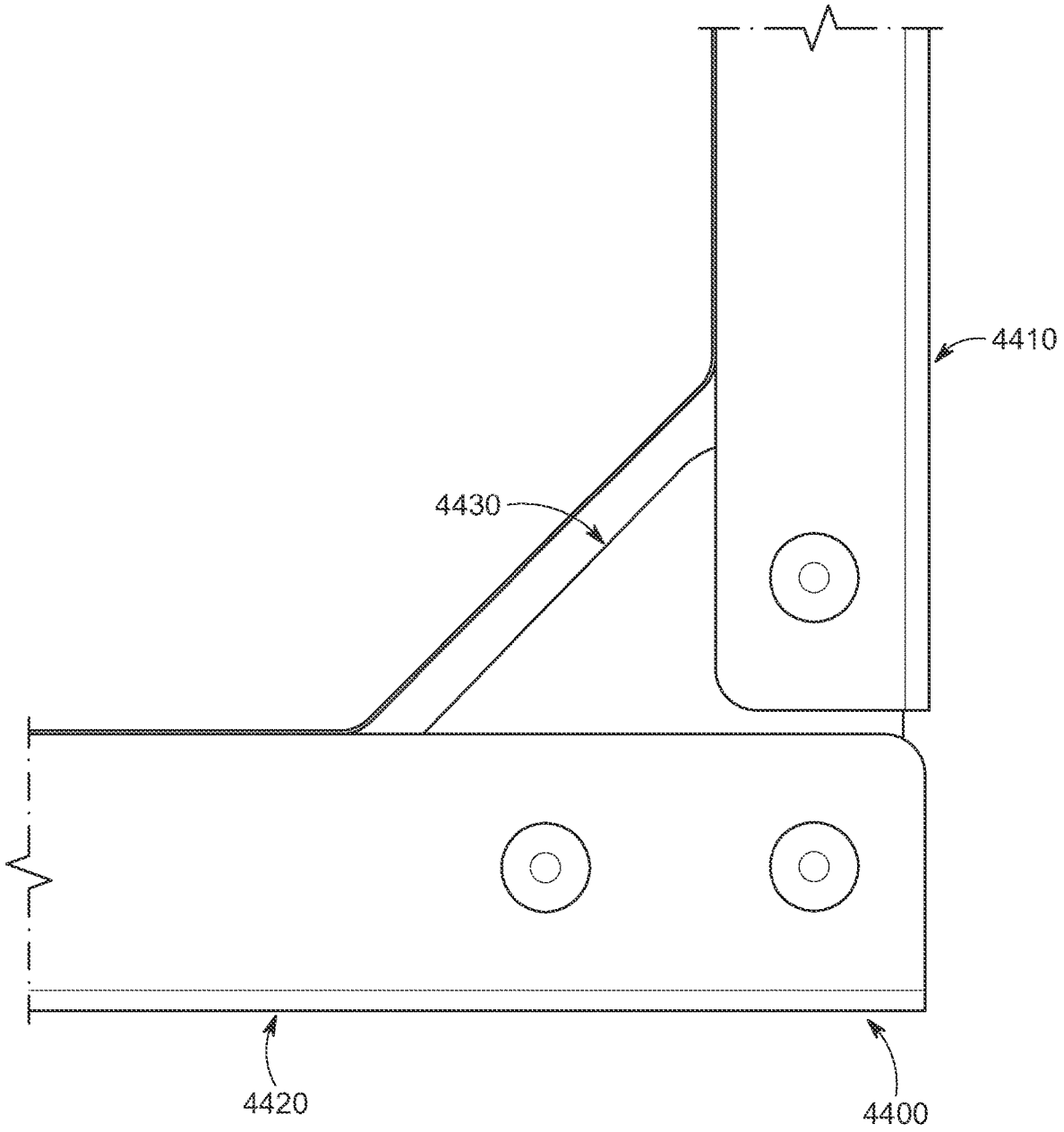
FIG. 17 is a side view of a side wall support bracket that can be employed in a gondola railroad car of another example embodiment of the present disclosure.

FIG. 17 illustrates a third example alternative side wall support bracket 4400 that includes an upwardly vertically extending side wall support 4410, an outwardly horizontally extending floor support 4420, and a corner support 4430 connecting the lower portion of the side wall support 4410 to the outer portion of floor support 4420. The corner support 4430 includes two spaced-apart plates (one of which is shown) and three fasteners (not labeled) (such as bolts and nuts) connecting the plates to the side wall support 4410 and the floor support 4420. The side wall support 4410 includes a U-shaped member including an outer wall (not labeled) and two inwardly extending inner walls (not labeled). The two inwardly extending inner walls are weldable to the outer surface of the side wall. Likewise, the floor support 4420 includes a U-shaped member including an outer wall (not labeled) and two inner walls (not labeled) extending upwardly from the outer wall and weldable to the bottom outer surface of the floor. The corner support 4430 is configured to be mechanically fastened rather than being welded or otherwise rigidly connected to the floor-side-wall connector.

Figure 18:
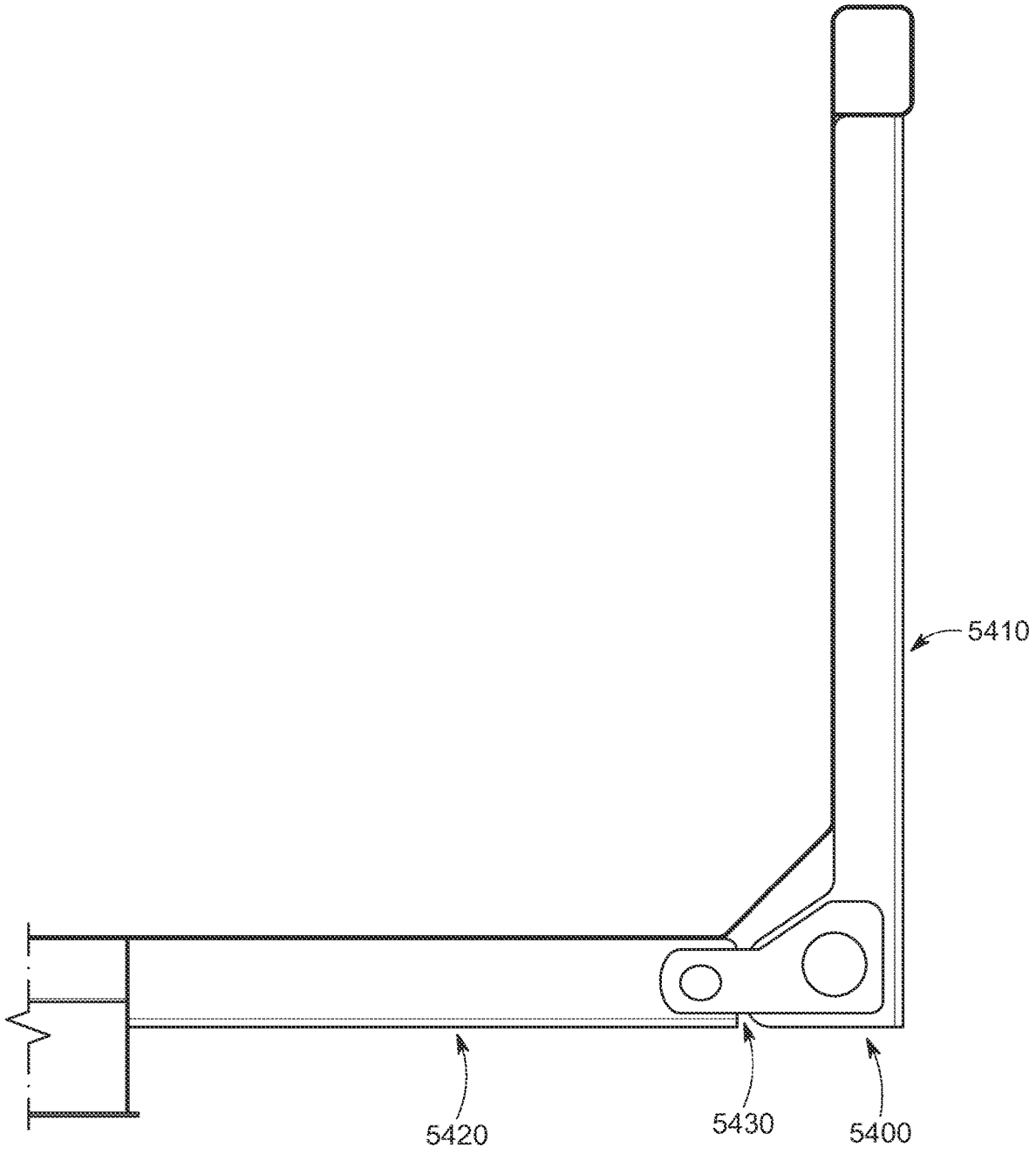
FIG. 18 is a side view of a side wall support bracket that can be employed in a gondola railroad car of another example embodiment of the present disclosure.

FIG. 18 illustrates a fourth example alternative side wall support bracket 5400 that includes an upwardly vertically extending side wall support 5410, an outwardly horizontally extending floor support 5420, and a corner support 5430 connecting the lower portion of the side wall support 5410 to the outer portion of floor support 5420. The corner support 5430 includes two spaced-apart plates (one of which is shown) and two slot welds (where the size and shape may vary) (not labeled) connecting the plates to the side wall support 5410 and the floor support 5420. The side wall support 5410 includes a U-shaped member including an outer wall (not labeled) and two inwardly extending inner walls (not labeled). The two inwardly extending inner walls are weldable to the outer surface of the side wall. Likewise, the floor support 5420 includes a U-shaped member including an outer wall (not labeled) and two inner walls (not labeled) extending upwardly from the outer wall and weldable to the bottom outer surface of the floor. The corner support 5430 is configured to be welded or otherwise rigidly connected to the floor-side-wall connector.

Figure 19:
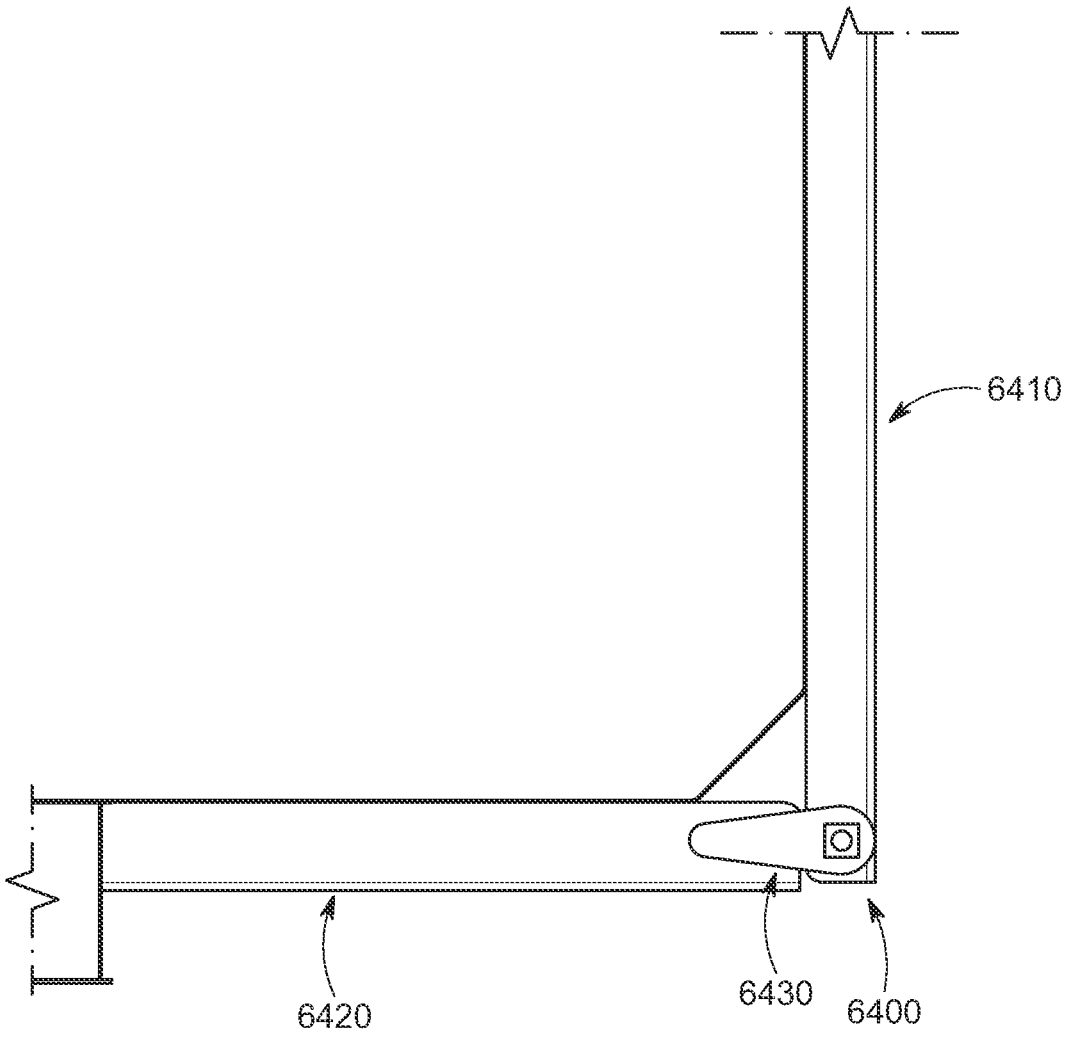
FIG. 19 is a side view of a side wall support bracket that can be employed in a gondola railroad car of another example embodiment of the present disclosure.

FIG. 19 illustrates a fifth example alternative side wall support bracket 6400 that includes an upwardly vertically extending side wall support 6410, an outwardly horizontally extending floor support 6420, and a corner support 6430 connecting the lower portion of the side wall support 6410 to the outer portion of floor support 6420. The corner support 6430 includes two spaced-apart plates (only one of which is shown) and one connection pin (not labeled) connecting the plates to the side wall support 6410. The plates are welded to the floor support 6420. The side wall support 6410 includes a U-shaped member including an outer wall (not labeled) and two inwardly extending inner walls (not labeled). The two inwardly extending inner walls are weldable to the outer surface of the side wall. Likewise, the floor support 6420 includes a U-shaped member including an outer wall (not labeled) and two inner walls (not labeled) extending upwardly from the outer wall and weldable to the bottom outer surface of the floor. The corner support 6430 is configured to be welded or otherwise rigidly connected to the outwardly horizontally extending floor support 6420, and pinned (rather than being welded) to the lower portion of the side wall support 6410.

Figure 20:
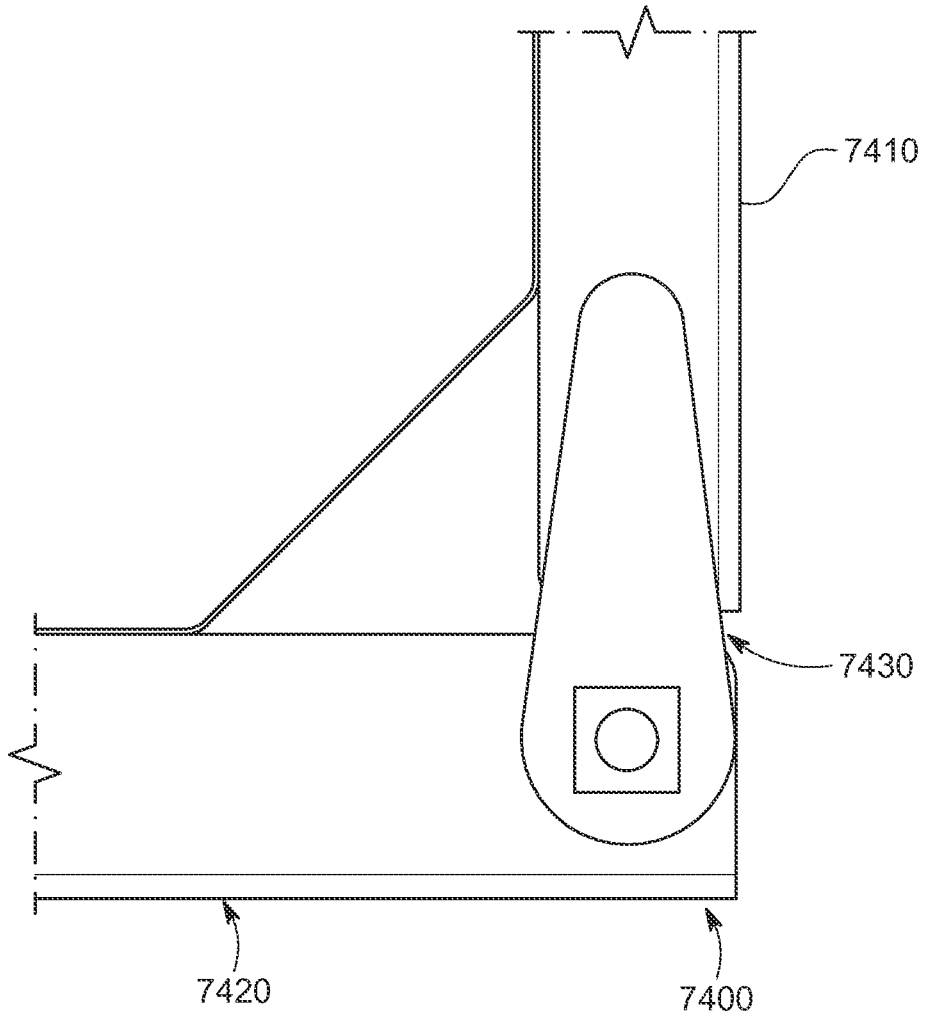
FIG. 20 is a side view of a side wall support bracket that can be employed in a gondola railroad car of another example embodiment of the present disclosure.

FIG. 20 illustrates a sixth example alternative side wall support bracket 7400 that includes an upwardly vertically extending side wall support 7410, an outwardly horizontally extending floor support 420, and a corner support 7430 connecting the lower portion of the side wall support 7410 to the outer portion of floor support 7420. The corner support 7430 includes two spaced-apart plates (only one of which is shown) and one connection pin (not labeled) connecting the plates to the floor support 7420. The plates are welded to the side wall support 7410. The side wall support 7410 includes a U-shaped member including an outer wall (not labeled) and two inwardly extending inner walls (not labeled). The two inwardly extending inner walls are weldable to the outer surface of the side wall. Likewise, the floor support 7420 includes a U-shaped member including an outer wall (not labeled) and two inner walls (not labeled) extending upwardly from the outer wall and weldable to the bottom outer surface of the floor. The corner support 7430 is configured to be pinned to the outwardly horizontally extending floor support 7420, and welded or otherwise rigidly connected to the lower portion of the side wall support 7410.

Figure 21:
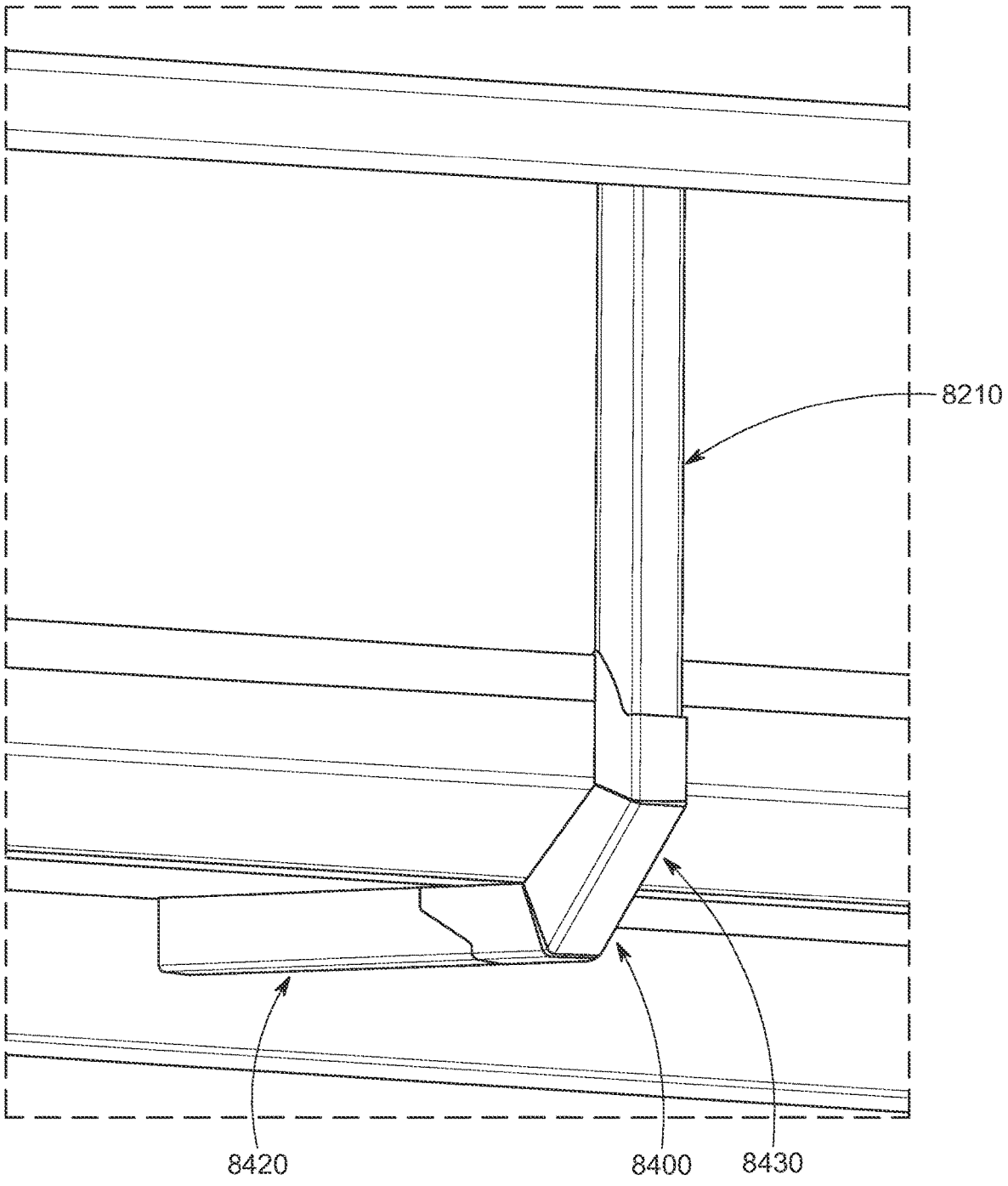
FIGS. 21 and 22 are perspective and side views of a side wall support bracket that can be employed in a gondola railroad car of another example embodiment of the present disclosure.
Figure 22:
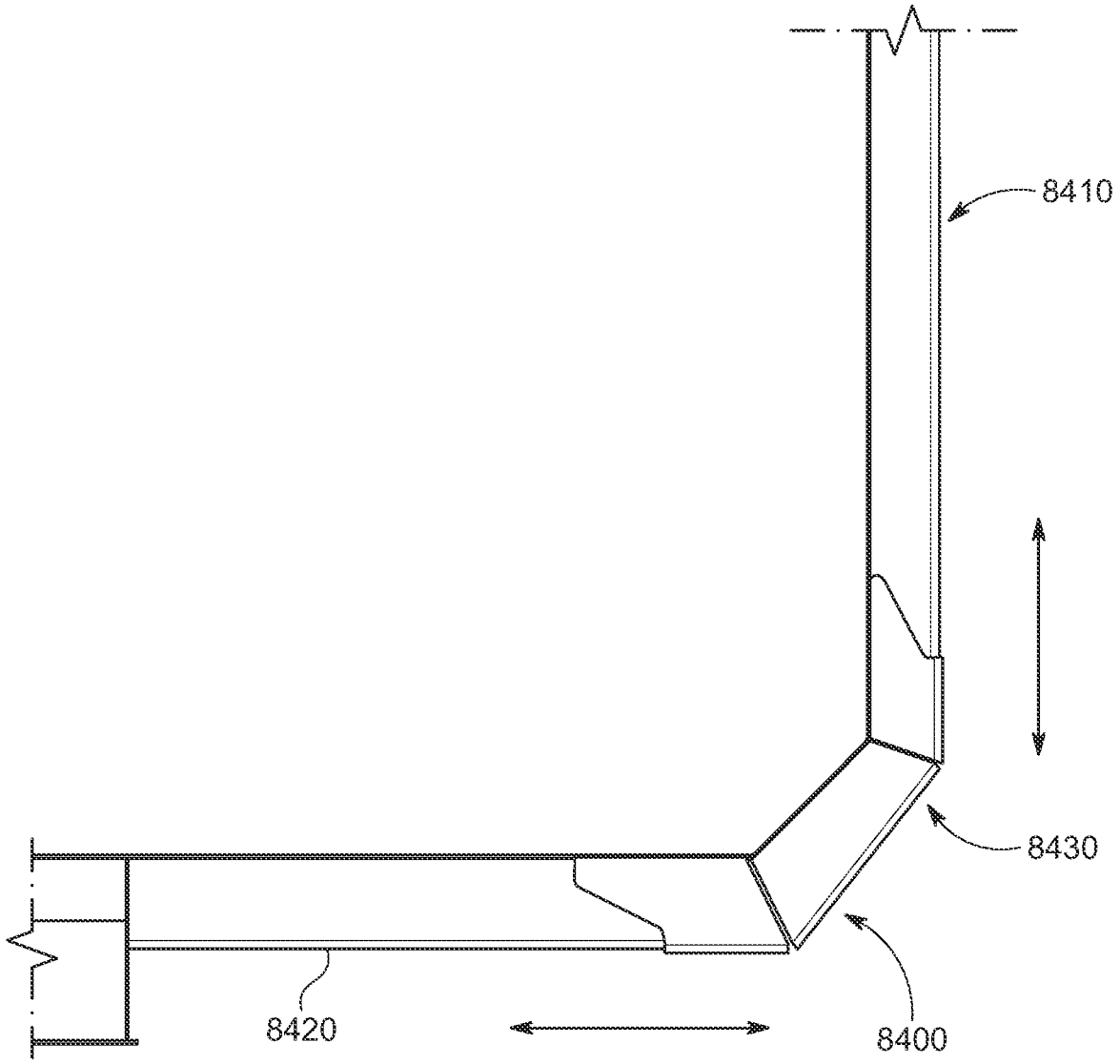

FIGS. 21 and 22 illustrate a seventh example alternative side wall support bracket 8400 that includes an upwardly vertically extending side wall support 8410, an outwardly horizontally extending floor support 8420, and a corner support 8430 connecting the lower portion of the side wall support 8410 to the outer portion of floor support 8420. The corner support 8430 includes a bent sleeve that receives the side wall support 8410 and the floor support 8420 at opposite ends. The bent sleeve is welded to the side wall support 8410 and the floor support 8420. The side wall support 8410 includes a U-shaped member including an outer wall (not labeled) and two inwardly extending inner walls (not labeled). The two inwardly extending inner walls are weldable to the outer surface of the side wall. Likewise, the floor support 8420 includes a U-shaped member including an outer wall (not labeled) and two inner walls (not labeled) extending upwardly from the outer wall and weldable to the bottom outer surface of the floor. The corner support 8430 is configured to be welded or otherwise rigidly connected to the outwardly horizontally extending floor support 8420, the lower portion of the side wall support 7410 and to the floor-side-wall connector.

Figure 23:
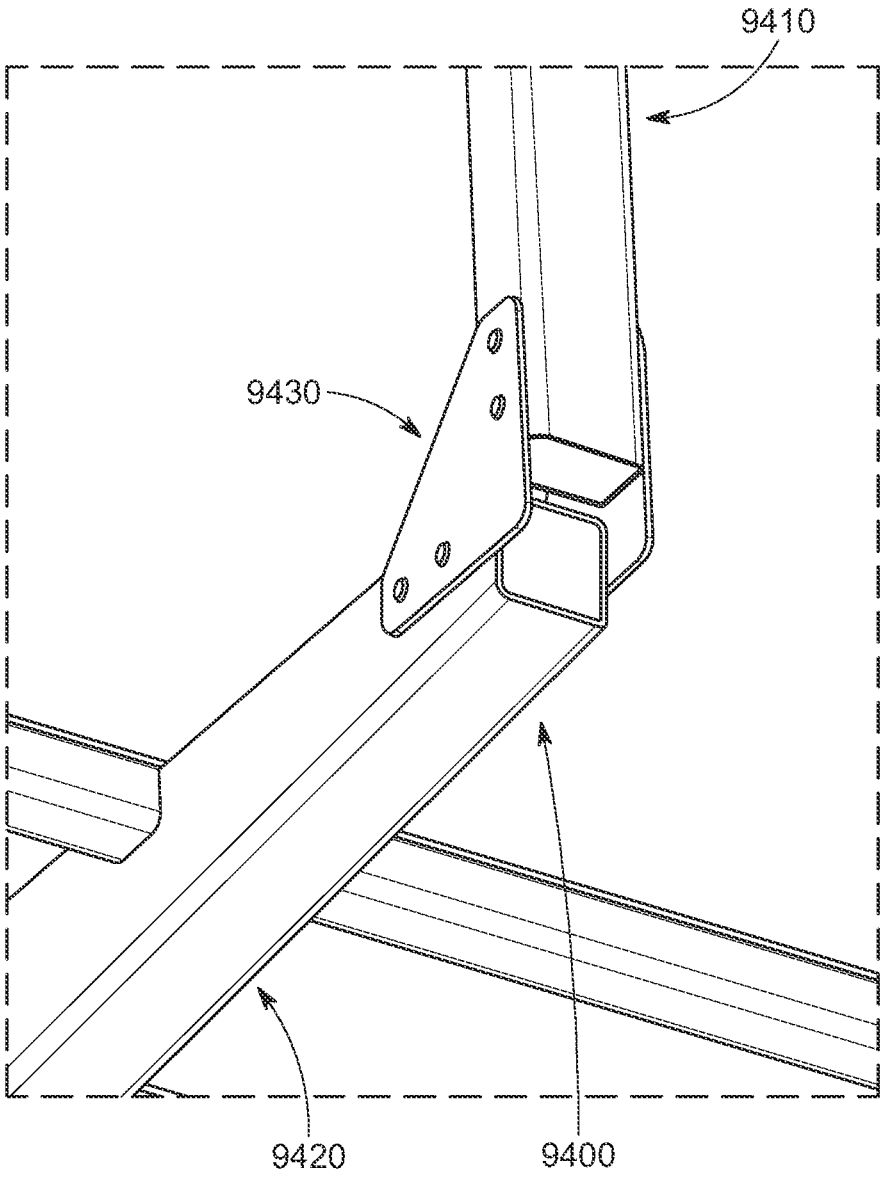
FIGS. 23 and 24 are front and rear perspective views of a side wall support bracket that can be employed in a gondola railroad car of another example embodiment of the present disclosure.
Figure 24:
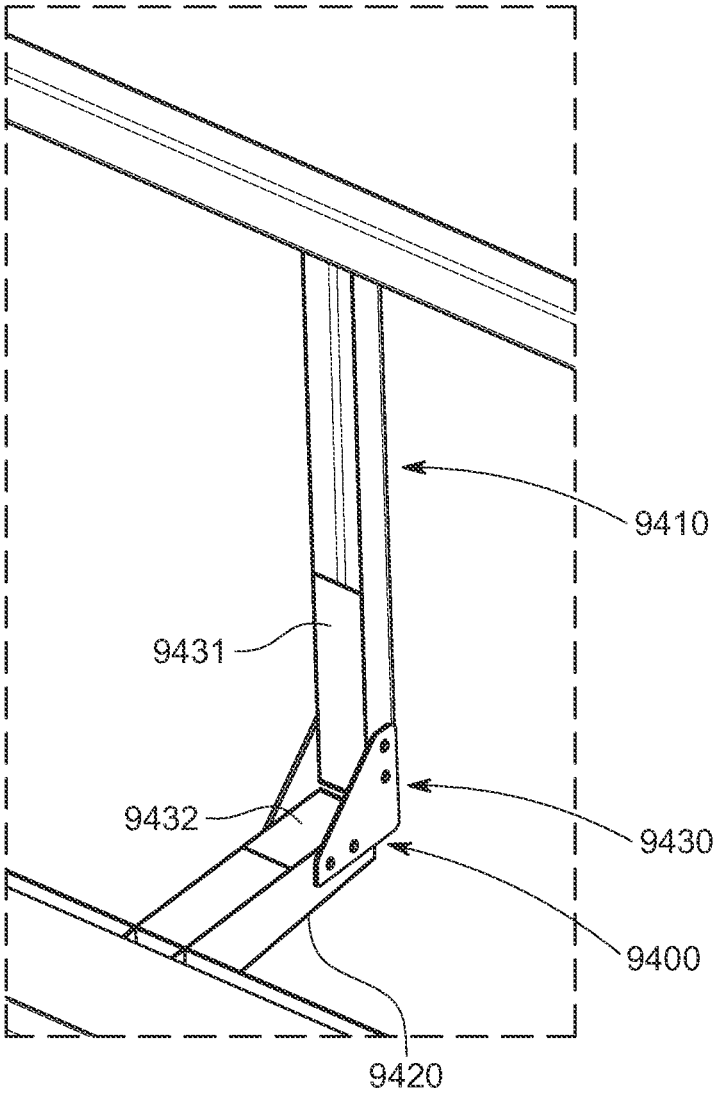

FIGS. 23 and 24 illustrate an eighth example alternative side wall support bracket 9400 that includes an upwardly vertically extending side wall support 9410, an outwardly horizontally extending floor support 9420, and a corner support 9430 connecting the lower portion of the side wall support 9410 to the outer portion of floor support 9420. The corner support 9430 includes two spaced-apart plates (not labeled) and four fasteners (not labeled) (such as bolts and nuts) connecting the plates to the side wall support 9410 and the floor support 9420. The side wall support 9410 and the floor support 9420 include openings (not shown) for the fasteners. The side wall support 9410 includes a U-shaped member including an outer wall (not labeled) and two inwardly extending inner walls (not labeled). The two inwardly extending inner walls are weldable to the outer surface of the side wall. Likewise, the floor support 9420 includes a U-shaped member including an outer wall (not labeled) and two inner walls (not labeled) extending upwardly from the outer wall and weldable to the bottom outer surface of the floor. FIG. 24 shows closure member 9431 connected to the side wall support 9410 and closure member 9432 connected to the floor support 9420. These closure members enhance support of the floor-side-wall connector by the corner support 9430 in a rigid manner. Such closure members like closure members 9431 and 9432 can present in various embodiments of the side wall support bracket. Alternative closure members can include one or more supports that extend toward or to the outer wall. The corner support 9430 is configured to be mechanically fastened rather than being welded or otherwise rigidly connected to the floor-side-wall connector.

FIGS. 25, 26, 27, 28, and 29 illustrate certain components of a gondola railroad car 11020 of another example embodiment of the present disclosure. This example embodiment is different than the above example embodiments in the alternative configurations of the frame and the containment structure of the gondola railroad car. This alternative frame can be employed in the gondola railroad cars described above. This alternative containment structure can be employed in the gondola railroad cars described above.

This gondola railroad car 11020 generally includes: (1) a frame 11030; (2) spaced apart trucks (not shown) configured to support the frame 11030; and (3) a plurality of sets of wheels (not shown) that respectively support the trucks. The gondola railroad car 11020 includes a containment structure including: (4) a floor 11100 connected to and supported by the frame 11030; (5) a first side wall 11200 connected to and extending upwardly from the floor 11100; (6) a spaced-apart second side wall 11300 connected to and extending upwardly from the floor 11100; (7) a first floor-side-wall connector 11600 connecting the first side wall 11200 to the floor 11100; (8) a second floor-side-wall connector 11900 connecting the second side wall 11300 to the floor 1110; (9) a first end wall 11700 connected to the floor 11100, the first side wall 11200, and the second side wall 11300; and (10) a spaced-apart second end wall 11800 connected to the floor 11100, the first side wall 11200, and the second side wall 11300. This gondola railroad car 20 includes a containment support assembly including: (11) a plurality of spaced-apart first side wall support brackets 11400*a*, 11400*b*, 11400*c*, 11400*d*, 11400*e*, 11400*f*, 11400*g*, and 11400*h* connected to and extending upwardly from the frame 11030 and connected to the floor 11000 and the first side wall 11200; (12) a pair spaced-apart first side wall end support brackets 11450*a* and 11450*b* connected to and extending upwardly from the frame 11030 and connected to the first side wall 11200; (13) a plurality of spaced-apart second side wall support brackets (not shown in detail) connected to and extending upwardly from the frame 11030 and connected to the floor 11100 and the second side wall 11300; and (14) a pair spaced-apart second side wall end support brackets (not shown) connected to and extending upwardly from the frame 11030 and connected to the second side wall 11300.

Figure 25:
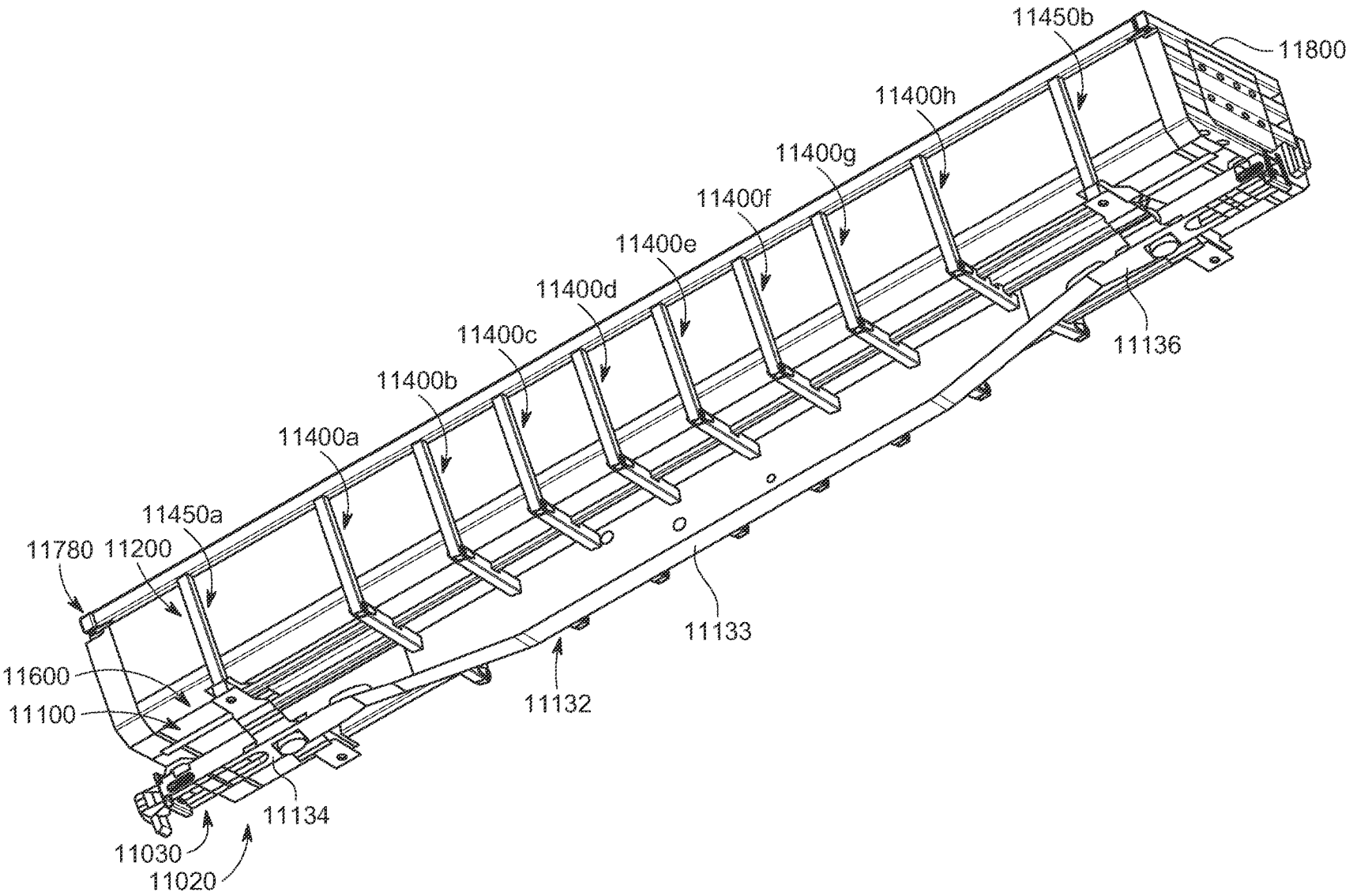
FIG. 25 is a bottom perspective view of a gondola railroad car of another example embodiment of the present disclosure, shown without the trucks and wheels of the gondola railroad car and including elongated longitudinally extending high strength members.

More specifically, in this example embodiment, the frame 11130 includes an elongated longitudinally extending center sill 11132 that includes a longitudinally extending central member 11133, a longitudinally extending first stub sill assembly 11134 at a first end of the center sill 11132, and a longitudinally extending second stub sill assembly 11136 at the opposite second end of the center sill 11132, as best shown in FIG. 25. The frame 11130 is different from the above described frames in the configuration of these components. In this example embodiment, the center sill 11132 includes what is known in the railroad industry as a fish belly configuration best shown in FIG. 25 to provide additional structural support for the containment structure of this example embodiment.

Figure 28:
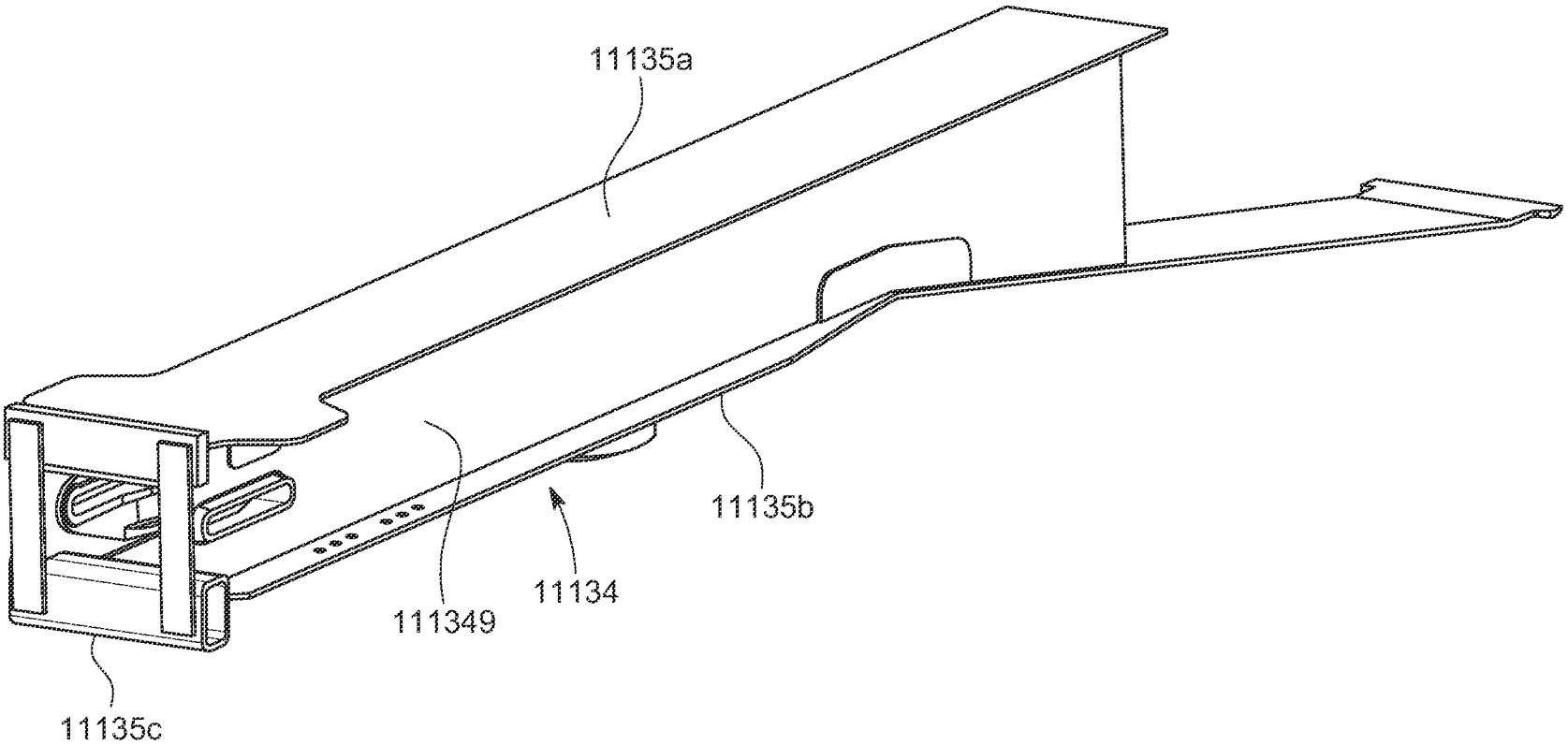
FIG. 28 is a top perspective view of part of the frame of the gondola railroad car of FIG. 25.
Figure 29:
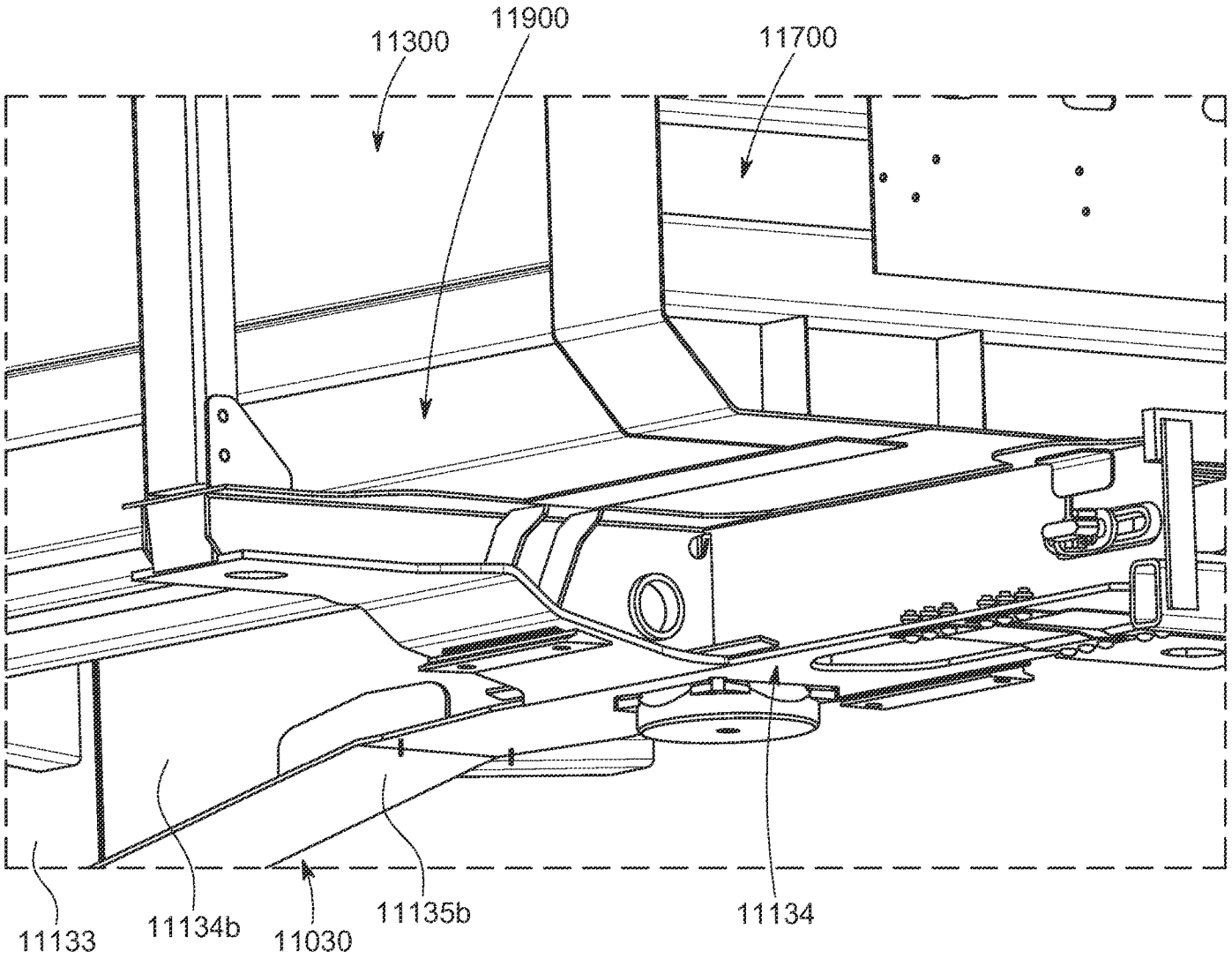
FIG. 29 is a bottom perspective view of part of the frame of the gondola railroad car of FIG. 25.

In this example embodiment, the first stub sill assembly 11134 includes two spaced apart side walls 11134*a* and 11134*b*, a top wall 11135*a*, and a bottom wall 11135*b* that are suitably connected as shown in FIGS. 28 and 29. In this example embodiment, the side walls 11134*a* and 11134*b*, the top wall 11135*a*, the bottom wall 11135*b*, and the end member 11135*c* are all made and steel and rigidly connected by welding. In this example embodiment, the side walls 11134*a* and 11134*b*, the top wall 11135*a*, the bottom wall 11135*b*, and the end member 11135*c* are all made and steel and rigidly connected. In this example embodiment, the side walls 11134*a* and 11134*b* are made from steel having a yield strength of 100 ksi, the top wall 11135*a* and the bottom wall 11135*b* are made from steel having a yield strength of 65 ksi, and the end member 11135*c* is made from steel having a yield strength in a range from 50 ksi through 175 ksi. This configuration provided the first stub sill assembly 11134 with sufficient strength to support the containment structure of this gondola railroad car 11020. This second stub sill assembly 11136 configured in the same manner and is thus not described in any detail.

Figure 26:
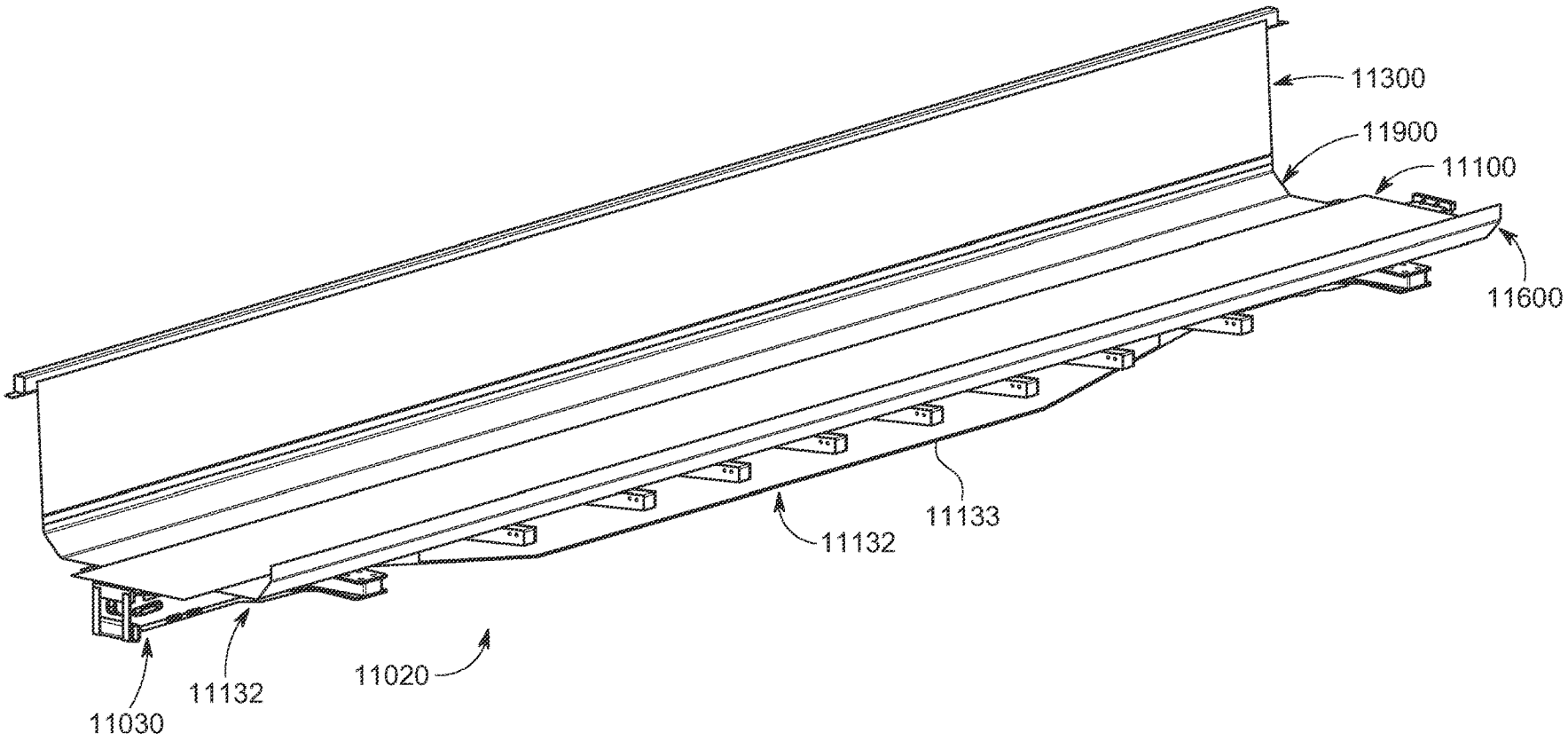
FIG. 26 is a top perspective view of certain parts of the gondola railroad car of FIG. 25.
Figure 27:
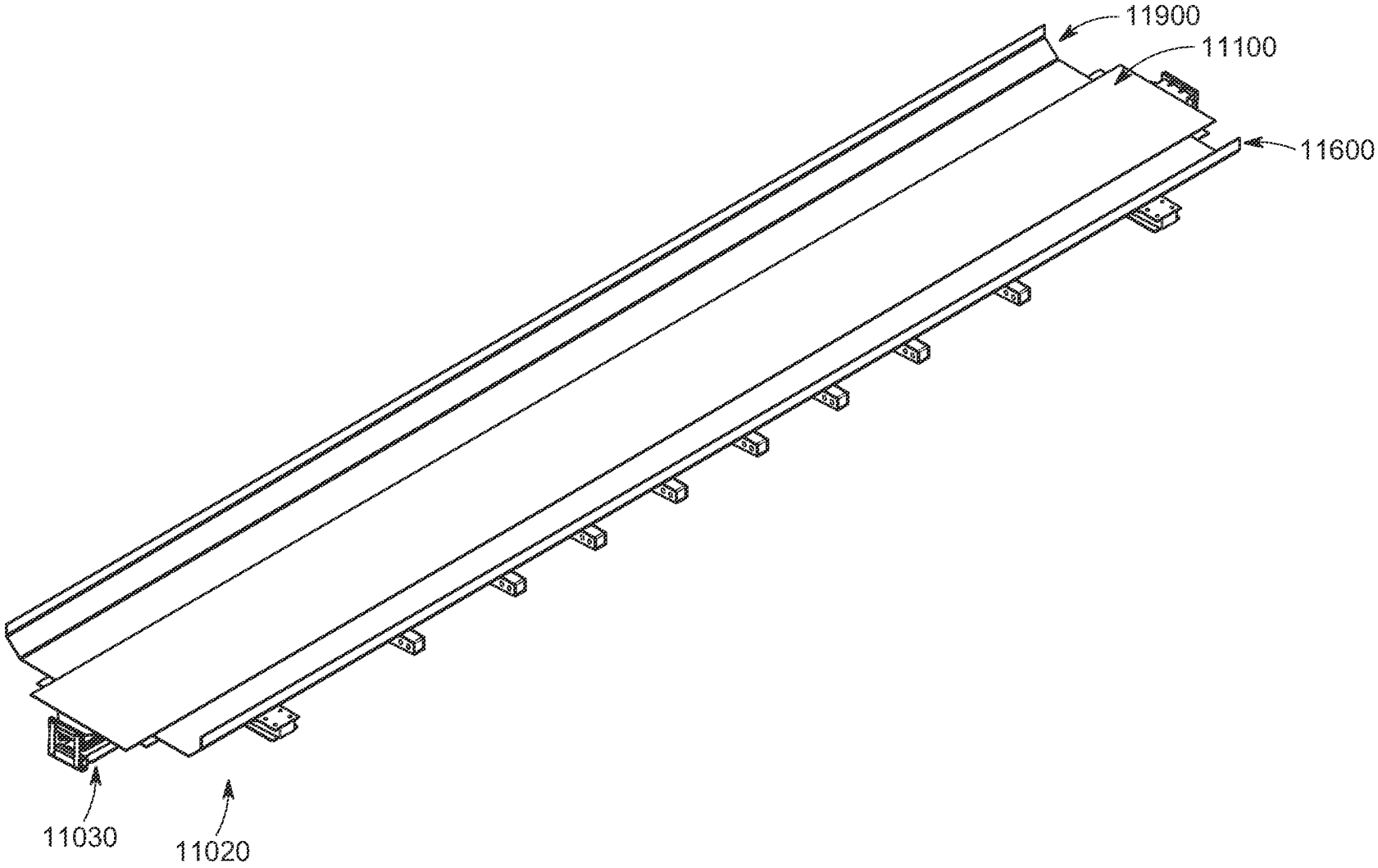
FIG. 27 is a top perspective view of certain parts of the gondola railroad car of FIG. 25.

In this example embodiment, as best shown in FIGS. 26 and 27, the floor 11100 includes a single elongated longitudinally extending steel member that extends the length of the gondola railroad car 11120 from the first end wall 11700 to the second end wall 11800. The floor 11100 is flat and extends horizontally or substantially horizontally. This configuration forming the floor 11100 as a single member eliminates any weaknesses in the floor formed by welds that would be used to connect separate members that form the floor. In this embodiment, the width of the floor 11100 can be equal to the width of the steel coil used to form such member. Example coil widths can vary from 40 inches to 80 inches depending on the manufacturer, steel grade, thickness, and length. In this example embodiment, the floor 11100 is formed from high strength steel and particularly from ultra-high strength steel having a yield strength of 175 ksi.

In this example embodiment, the first side wall 11200 includes a single elongated longitudinally extending steel member that extends the length of the gondola railroad car 11120 from the first end wall 11700 to the second end wall 11800. The first side wall 11200 is flat and extends vertically or substantially vertically. This configuration forming the first side wall 11200 as a single member eliminates any weaknesses in the first side wall formed by welds that would be used to connect separate members that form the first side wall. In this embodiment, the width of the first side wall 11200 can be equal to the width of the steel coil used to form such member. Example coil widths can vary from 40 inches to 80 inches depending on the manufacturer, steel grade, thickness, and length. In this example embodiment, the first side wall 11200 is formed from high strength steel and particularly from ultra-high strength steel having a yield strength of 175 ksi.

Likewise, in this example embodiment, as best shown in FIG. 26, the second side wall 11300 includes a single elongated longitudinally extending steel member that extends the length of the gondola railroad car 11120 from the first end wall 11700 to the second end wall 11800. The second side wall 11300 is flat and extends vertically or substantially vertically. This configuration forming the second side wall 11300 as a single member eliminates any weaknesses in the second side wall formed by welds that would be used to connect separate members that form the second side wall. In this embodiment, the width of the second side wall 11300 can be equal to the width of the steel coil used to form such member. Example coil widths can vary from 40 inches to 80 inches depending on the manufacturer, steel grade, thickness, and length. In this example embodiment, the second side wall 11300 is formed from high strength steel and particularly from ultra-high strength steel having a yield strength of 175 ksi.

In this example embodiment, as best shown in FIGS. 26 and 27, the first floor-side-wall connector 11600 includes a single elongated longitudinally extending steel member that extends the length of the gondola railroad car 11120 from the first end wall 11700 to the second end wall 11800. The first floor-side-wall connector 11600 is bent and extends partially vertically or substantially vertically and partially horizontally or substantially horizontally. In this example embodiment, the first floor-side-wall connector 11600 includes three elongated members (not labeled) and two elongated bends (not labeled), although the first floor-side-wall connector 11600 can be alternatively formed such as explained above in relation to FIG. 14. This configuration forming the first floor-side-wall connector 11600 as a single member eliminates any weaknesses in the first floor-side-wall connector 11600 formed by welds that would be used to connect separate members that form the first floor-side-wall connector 11600. In this embodiment, the width of the first floor-side-wall connector 11600 can be equal to the width of the steel coil used to form such member. Example coil widths can vary from 40 inches to 80 inches depending on the manufacturer, steel grade, thickness, and length. In this example embodiment, the first floor-side-wall connector 11600 is formed from high strength steel and particularly from ultra-high strength steel having a yield strength of 175 ksi.

In this example embodiment, as best shown in FIGS. 26 and 27, the second floor-side-wall connector 11900 includes a single elongated longitudinally extending steel member that extends the length of the gondola railroad car 11120 from the first end wall 11700 to the second end wall 11800. The second floor-side-wall connector 11900 is bent and extends partially vertically or substantially vertically and partially horizontally or substantially horizontally. In this example embodiment, the second floor-side-wall connector 11900 includes three elongated members (not labeled) and two elongated bends (not labeled), although the second floor-side-wall connector 11900 can be alternatively formed such as explained above in relation to FIG. 14. This configuration forming the second floor-side-wall connector 11900 as a single member eliminates weaknesses in the second floor-side-wall connector 11900 formed by welds that would be used to connect separate members that form the second floor-side-wall connector 11900. In this embodiment, the width of the second floor-side-wall connector 11900 can be equal to the width of the steel coil used to form such member. Example coil widths can vary from 40 inches to 80 inches depending on the manufacturer, steel grade, thickness, and length. In this example embodiment, the second floor-side-wall connector 11900 is formed from high strength steel and particularly from ultra-high strength steel having a yield strength of 175 ksi.

In this example embodiment, the floor 11100 is welded to the first floor-side-wall connector 11600 along a single elongated weld connection area (not labeled), the floor 11100 is welded to the second floor-side-wall connector 11900 along a single elongated weld connection area (not labeled), the first floor-side-wall connector 11600 is welded to the first side wall 11200 along a single elongated weld connection area (not labeled), and the second floor-side-wall connector 11600 is welded to the second side wall 11300 along a single elongated weld connection area (not labeled). Thus, this example embodiment only includes four elongated weld connection areas that each extend the length of the gondola railroad car 11120 from the first end wall 11700 to the second end wall 11800. In other words, in this example, the floor, the first side wall, the second side wall, the first floor-side-wall connector, and the second floor-side-wall connector are connected together by only longitudinal welds. This configuration reduces the quantity of transverse welds that have a relatively lower fatigue resistance than such longitudinal welds.

In this example embodiment, these four longitudinal weld connection areas are positioned to be supported by the respective corner members of the side wall support brackets in a similar manner as explained above, and as further explained below.

The first and second side walls 11200 and 11300 can each further include an upper brace (not labeled) such as described above. In this example embodiment, the upper braces can be made from a steel member made from 100 ksi material. In other embodiments, the upper braces have a yield strength in the range from 100 ksi through 175 ksi. It should be appreciated that the upper braces can be alternatively shaped, sized, and otherwise configured in accordance with the present disclosure.

In various embodiments, the gondola railroad car 11020 can include one or more elongated weld connection area reinforcement members (not shown). Each of these reinforcement members can be intermittent or can extend the entire length of the car.

The plurality of first side wall support brackets 11400*a*, 11400*b*, 11400*c*, 11400*d*, 11400*e*, 11400*f*, 11400*g*, and 11400*g* are spaced-apart along the longitudinal length of and adjacent to the outer surfaces of the floor 11100, the first floor-side-wall connector 11600, and the first side wall 11200 to provide additional support for the floor 11100, the first floor-side-wall connector 11600, and the first side wall 11200 at designated areas. The first side wall support brackets 11400*a*, 11400*b*, 11400*c*, 11400*d*, 11400*e*, 11400*f*, 11400*g*, and 11400*h* are identical in this example embodiment, and can be identical to any of the above described wall support brackets and are thus not described in detail herein for brevity.

Likewise, the plurality of second side wall support brackets are spaced-apart along the longitudinal length of and adjacent to the outer surfaces of the floor 11100, the second floor-side-wall connector 11900, and the second side wall 11300 to provide additional support for the floor 11100, the second floor-side-wall connector 11900, and the second side wall 11200 at designated areas. The second side wall support brackets are identical in this example embodiment, and can be identical to any of the above described wall support brackets and are thus not described in detail herein for brevity.

The first and second side wall support brackets provide non-rigid support for the first floor-side-wall connector 11600 and the second floor-side-wall connector 11900. These non-rigid connections enable the resulting joint to flex to a certain extent to absorb loads. In this example embodiment, the first and second side wall support brackets are made from steel members, wherein each steel member is made from 100 ksi material. In other embodiments, these members can have a yield strength in the range from 50 ksi through 175 ksi. It should be appreciated that the first and second side wall support brackets can be alternatively shaped, sized, and otherwise configured in accordance with the present disclosure, such as but not limited to the alternative examples described below.

Similar to the above described embodiments, the plurality of first side wall end support brackets 11450*a* and 11450*b* are spaced-apart at the end members of the first side wall 11200 to provide additional support for the first side wall 11200. Likewise, the plurality of second side wall end support brackets (not shown or labeled) are spaced-apart at the end members of the second side wall 11300 to provide additional support for the second side wall 11300. In this example embodiment, the first and second side wall end support brackets are made from steel members, wherein each steel member is made from 100 ksi material. In other embodiments, these members can have a yield strength in the range from 50 ksi through 175 ksi. It should be appreciated that the first and second side wall end support brackets can be alternatively shaped, sized, and otherwise configured in accordance with the present disclosure.

It should be appreciated that the configuration and size of the gondola railroad car can vary in accordance with the present disclosure.

It will be understood that modifications and variations may be effected without departing from the scope of the novel concepts of the present invention, and it is understood that this application is to be limited only by the scope of the claims.

The invention claimed is:

1. A railroad car comprising:

a frame;

a containment structure including a floor, a first side wall, a second side wall, a first floor-side-wall connector connecting the floor and the first side wall, and a second floor-side-wall connector connecting the floor to the second side wall; and a plurality of first support brackets connected to the frame and supporting the containment structure, each of the first support brackets including:

a first floor connection member rigidly connected to the floor, a first side wall connection member rigidly connected to the first side wall, wherein neither of the first floor connection member nor the first side wall connection member are rigidly connected to the first floor-side-wall connector, and a non-rigid corner support connecting the first floor connection member to the first side wall connection member.

2. The railroad car of claim 1, wherein the first floor-side-wall connector is at least partially defined by at least one of the floor and the first side wall, and wherein the second floor-side-wall connector is at least partially defined by at least one of the floor and the second side wall.

3. The railroad car of claim 1, wherein the floor includes at least one ultra-high strength steel member, wherein the first side wall includes at least one ultra-high strength steel member, and wherein the second side wall includes at least one ultra-high strength steel member.

4. The railroad car of claim 3, wherein the first floor-side-wall connector is at least partially defined by at least one of the floor and the first side wall, and wherein the second floor-side-wall connector is at least partially defined by at least one of the floor and the second side wall.

5. The railroad car of claim 1, wherein the floor includes at least one ultra-high strength steel member, wherein the first side wall includes at least one ultra-high strength steel member, wherein the second side wall includes at least one ultra-high strength steel member, wherein the first floor-side-wall connector includes at least one ultra-high strength steel member, and wherein the second floor-side-wall connector includes at least one ultra-high strength steel member.

6. The railroad car of claim 1, wherein the floor includes only one ultra-high strength steel member, wherein the first side wall includes only one ultra-high strength steel member, wherein the second side wall includes only one ultra-high strength steel member, wherein the first floor-side-wall connector includes only one ultra-high strength steel member, and wherein the second floor-side-wall connector includes only one ultra-high strength steel member.

7. The railroad car of claim 1, wherein the floor is formed from a plurality of ultra-high strength steel members welded together, wherein the first side wall is formed from a plurality of ultra-high strength steel members welded together, and wherein the second side wall is formed from a plurality of ultra-high strength steel members welded together.

8. The railroad car of claim 1, wherein the floor is formed from a plurality of ultra-high strength steel members welded together, wherein the first side wall is formed from a plurality of ultra-high strength steel members welded together, wherein the second side wall is formed from a plurality of ultra-high strength steel members welded together, wherein the first floor-side-wall connector is formed from a plurality of ultra-high strength steel members welded together, and wherein the second floor-side-wall connector is formed from a plurality of ultra-high strength steel members welded together.

9. The railroad car of claim 1, wherein the floor, the first side wall, and the second side wall are formed by a plurality of connected ultra-high strength steel U-shaped members.

10. The railroad car of claim 1, wherein for each of the first support brackets, the first floor connection member is welded to the floor and the first side wall connection member is welded to the first side wall.

11. The railroad car of claim 1, which includes:

a plurality of second support brackets connected to the frame and supporting the containment structure, each of the second support brackets including:

a second floor connection member rigidly connected to the floor, a second side wall connection member rigidly connected to the second side wall, wherein neither of the second floor connection member nor the second side wall connection member are rigidly connected to the second floor-side-wall connector, and a non-rigid corner support connecting the first floor connection member to the first side wall connection member.

12. The railroad car of claim 11, wherein for each of the second support brackets, the second floor connection member is welded to the floor and the second side wall connection member is welded to the second side wall.

13. The railroad car of claim 1, wherein:

the floor is welded to the first floor-side-wall connected along a longitudinally extending first weld connection area, the floor is welded to the second floor-side-wall connected along a longitudinally extending second weld connection area, the first floor-side-wall is welded to the first side wall connected along a longitudinally extending third weld connection area, and the second floor-side-wall is welded to the second side wall connected along a longitudinally extending fourth weld connection area.

14. The railroad car of claim 1, wherein:

the floor includes elongated flat ultra-high strength steel first and second members welded together along a longitudinally extending weld connection area, the first side wall includes an elongated ultra-high strength steel flat member, the first floor-side-wall connector includes an elongated ultra-high strength steel bent member, the second side wall includes an elongated ultra-high strength steel flat member, and the second floor-side-wall connector includes an elongated ultra-high strength steel bent member.

15. The railroad car of claim 1, wherein the floor, the first side wall, the second side wall, the first floor-side-wall connector, and the second floor-side-wall connector define two opposing end members and a central member of the containment structure, and wherein the end members have a greater thickness than the central member.

16. The railroad car of claim 1, wherein the floor, the first side wall, the second side wall, the first floor-side-wall connector, and the second floor-side-wall connector are connected together by only longitudinal welds.

17. A railroad car comprising:

a frame;

a containment structure including a floor, a first side wall, a second side wall, a first floor-side-wall connector connecting the floor and the first side wall, and a second floor-side-wall connector connecting the floor to the second side wall, wherein the floor, the first side wall, the second side wall, the first floor-side-wall connector, and the second floor-side-wall connector are connected together by only longitudinal welds, wherein the first floor-side-wall connector includes:

a bottom section connected to the floor by one of the longitudinal welds, the bottom section extending at a first angle relative to the floor, a top section connected to the first side wall by another one of the longitudinal welds, the top section extending at a second angle relative to the floor, and an intermediate section connecting the bottom section and the top section of the first floor-side-wall connector, the intermediate section extending at a third angle relative to the floor, the intermediate section extending at a first acute angle relative to the bottom section and at a second acute angle relative to the top section, wherein the first, second, and third angles are different; and a plurality of first support brackets each including:

a first floor connection member rigidly connected to the floor, a first side wall connection member rigidly connected to the first side wall, wherein neither of the first floor connection member nor the first side wall connection member are rigidly connected to the first floor-side-wall connector, and a corner support connecting the first floor connection member to the first side wall connection member.

18. The railroad car of claim 17, wherein corner support connecting the first floor connection member to the first side wall connection member is a non-rigid connector.

19. The railroad car of claim 17, wherein corner support connecting the first floor connection member to the first side wall connection member includes a plate and a plurality of bolts connecting the plate to the first floor connection member and to the first side wall connection member.

20. The railroad car of claim 17, wherein corner support connecting the first floor connection member to the first side wall connection member includes two plates and a plurality of bolts connecting the plates to the first floor connection member and to the first side wall connection member.

21. A railroad car comprising:

a frame;

a containment structure including:

a longitudinally extending floor, a longitudinally extending first side wall, a longitudinally extending second side wall, a longitudinally extending first floor-side-wall connector connecting the longitudinally extending floor and the longitudinally extending first side wall, and a longitudinally extending second floor-side-wall connector connecting the longitudinally extending floor to the longitudinally extending second side wall, wherein the longitudinally extending floor, the longitudinally extending first side wall, the longitudinally extending second side wall, the longitudinally extending first floor-side-wall connector, and the longitudinally extending second floor-side-wall connector includes:

two spaced-apart longitudinally extending end members, and a longitudinally extending central member that longitudinally extends between and is connected to the two spaced-apart longitudinally extending end members, and wherein the longitudinally extending end members each have a greater thickness than the central member; and a plurality of first support brackets each including:

a first floor connection member rigidly connected to the floor, a first side wall connection member rigidly connected to the first side wall, wherein neither of the first floor connection member nor the first side wall connection member are rigidly connected to the first floor-side-wall connector, and a corner support connecting the first floor connection member to the first side wall connection member.

22. The railroad car of claim 21, wherein corner support connecting the first floor connection member to the first side wall connection member is a non-rigid connector.

23. The railroad car of claim 21, wherein corner support connecting the first floor connection member to the first side wall connection member includes a plate and a plurality of bolts connecting the plate to the first floor connection member to the first side wall connection member.

24. The railroad car of claim 21, wherein corner support connecting the first floor connection member to the first side wall connection member includes two plates and a plurality of bolts connecting the plates to the first floor connection member to the first side wall connection member.

25. A railroad car comprising:

a frame;

a containment structure including a floor, a first side wall, a second side wall, a first floor-side-wall connector connecting the floor and the first side wall, and a second floor-side-wall connector connecting the floor to the second side wall; and a plurality of first support brackets each including:

a first floor connection member rigidly connected to the floor, a first side wall connection member rigidly connected to the first side wall, wherein neither of the first floor connection member nor the first side wall connection member are rigidly connected to the first floor-side-wall connector, and a corner support connecting the first floor connection member to the first side wall connection member.

26. The railroad car of claim 25, wherein for each of the first support brackets, the corner support connecting the first floor connection member to the first side wall connection member is a non-rigid connector.

27. The railroad car of claim 25, wherein for each of the first support brackets, the corner support connecting the first floor connection member to the first side wall connection member includes a plate connecting the first floor connection member to the first side wall connection member.

28. The railroad car of claim 25, wherein for each of the first support brackets, the corner support connecting the first floor connection member to the first side wall connection member including two plates connecting the first floor connection member to the first side wall connection member.

29. The railroad car of claim 25, wherein for each of the first support brackets, the corner support connecting the first floor connection member to the first side wall connection member includes a plate and a plurality of bolts connecting the plate to the first floor connection member to the first side wall connection member.

30. The railroad car of claim 25, wherein for each of the first support brackets, the corner support connecting the first floor connection member to the first side wall connection member includes two plates and a plurality of bolts connecting the two plates to the first floor connection member to the first side wall connection member.

31. The railroad car of claim 25, which includes a plurality of second support brackets each including:

a second floor connection member rigidly connected to the floor, a second side wall connection member rigidly connected to the second side wall, wherein neither of the second floor connection member nor the second side wall connection member are rigidly connected to the second floor-side-wall connector, and a second corner support connecting the second floor connection member to the second side wall connection member.

* * * * *